US010206441B2

(12) United States Patent
DuChene et al.

(10) Patent No.: US 10,206,441 B2
(45) **Date of Patent: *Feb. 19, 2019**

(54) SECURING SYSTEMS FOR GLOVES OR OTHER OBJECTS

(71) Applicant: NIKE, Inc., Beaverton, OR (US)

(72) Inventors: Marci S. DuChene, Beaverton, OR (US); Darien Curl, Beaverton, OR (US); Carl L. Madore, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 239 days.

This patent is subject to a terminal disclaimer.

(21) Appl. No.: 15/051,080

(22) Filed: Feb. 23, 2016

(65) Prior Publication Data

US 2016/0165977 A1 Jun. 16, 2016

Related U.S. Application Data

(63) Continuation of application No. 13/450,856, filed on Apr. 19, 2012, now Pat. No. 9,295,295.

(51) Int. Cl.
*A41D 19/00* (2006.01)
*A41F 1/06* (2006.01)
(Continued)

(52) U.S. Cl.
CPC ..... *A41D 19/0037* (2013.01); *A41D 19/0048* (2013.01); *A41F 1/06* (2013.01); *A43B 1/0054* (2013.01); *A43B 3/0078* (2013.01)

(58) Field of Classification Search
CPC ... A41D 19/0037; A41D 19/0048; A41F 1/06; A63B 71/146; A43B 1/0054; A43B 3/0078
(Continued)

(56) References Cited

U.S. PATENT DOCUMENTS 3,504,379 A 4/1970 Glick
3,588,917 A * 6/1971 Antonious ..... A63B 71/146 2/161.5
(Continued)

FOREIGN PATENT DOCUMENTS

DE 10059356 A1 6/2002
DE 202006014309 U1 12/2006

OTHER PUBLICATIONS

State Intellectual Property Office, Office Action for CN Application No. 201610121592.1, dated Aug. 21, 2017.
(Continued)

*Primary Examiner* — Khaled Annis
(74) *Attorney, Agent, or Firm* — Honigman Miller Schwartz and Cohn LLP; Matthew H. Szalach; Jonathan P. O'Brien

(57) ABSTRACT

Apparel, sporting equipment, and other items include magnetic securing systems (e.g., for holding a ball marker on a golf glove. Housings for such systems include a mount area defining a base surface that includes a magnet or is made from a magnetic material. At least two retaining walls extend from the mount area and together with the base surface define a receptacle for receiving another component (e.g., a golf ball marker) to be held by magnetic force. In such housings, a combined total perimeter length of interior surfaces of the retaining walls around the receptacle may be less than 50% of a total length around the perimeter of the component being held.

12 Claims, 18 Drawing Sheets

(51) Int. Cl.
*A43B 1/00* (2006.01)
*A43B 3/00* (2006.01)

(58) Field of Classification Search
USPC ..... 2/161.2, 161.4; D29/120.1, 123, 113, D29/116.2
See application file for complete search history.

(56) References Cited

U.S. PATENT DOCUMENTS 4,040,126 A 8/1977 Cecil
4,057,255 A * 11/1977 Bishop ..... A63B 69/0059 2/161.4
RE31,538 E * 3/1984 Antonious ..... A63B 71/146 2/160
4,519,097 A * 5/1985 Chappell, Jr. ..... A41D 19/015 2/159
4,639,947 A 2/1987 Lanscioni
D328,379 S 7/1992 Jones
5,328,449 A 7/1994 Andrews et al.
5,492,331 A * 2/1996 Kawakami ..... A41D 13/088 2/161.2
5,528,773 A 6/1996 Lowinger
5,638,548 A * 6/1997 Kawakami ..... A41D 13/088 2/161.1
5,742,941 A * 4/1998 Porter ..... A63B 71/146 2/161.4
6,210,389 B1 4/2001 Long et al.
6,295,743 B1 10/2001 Brooks
D459,816 S * 7/2002 Perricone ..... D2/621
6,964,063 B2 11/2005 Bamber
7,370,372 B1 * 5/2008 Brewer ..... A63B 71/146 2/160
7,895,671 B2 * 3/2011 Salomon ..... A41D 13/087 2/161.2
8,020,262 B2 9/2011 Oertel
D659,912 S * 5/2012 Tesfaye ..... D29/123
2005/0034213 A1 2/2005 Bamber
2007/0067891 A1 3/2007 Schauffele et al.
2007/0150999 A1 7/2007 Brown
2011/0004970 A1 1/2011 Okamoto
2013/0263356 A1 10/2013 Jones et al.

OTHER PUBLICATIONS

State Intellectual Property Office, P.R.C., Chinese Office Action for Application No. 201380031886.X, dated Jul. 14, 2015.
International Search Report and Written Opinion issued in International Patent Application No. PCT/US2013/036344 dated Jul. 31, 2013.
State Intellectual Property Office, P.R.C., Chinese Office Action for Application No. 201611230135965.0, dated Nov. 28, 2016.

* cited by examiner

SECURING SYSTEMS FOR GLOVES OR OTHER OBJECTS

CROSS REFERENCE TO RELATED APPLICATIONS

This application is a Continuation of U.S. Non-provisional application Ser. No. 13/450,856, filed Apr. 19, 2012, the disclosure of which is hereby incorporated by reference in its entirety.

FIELD OF THE INVENTION

One aspect of the present invention relates to the field of magnetic engagement or securing systems, e.g., for use in holding two components together. Some more specific examples of aspects of this invention relate to magnetic engagement systems for attaching a golf ball marker to another object, such as a golf glove, other golf equipment, articles of apparel, etc. As other examples, aspects of this invention may be used for magnetic closure mechanisms, e.g., for containers; as a replacement for buttons, snaps or other connectors; etc. Still additional aspects of this invention relate to gloves or other objects having hook-and-loop fastener type securing systems.

BACKGROUND

Many golfers wear at least one golf glove, for example, to protect the hand, to enhance the player's grip on the golf club, and/or to provide protection against the elements. Typically, at least the front surface of such gloves is made of a leather material (e.g., cabretta leather) or other suitable material that exhibits grip enhancing properties.

During play, many golfers find the need to reach into their pockets to remove various items, such as tees, ball markers, etc. Reaching into one's pocket with a gloved hand, however, can cause difficulties because the material of the golf glove also tends to grip the fabric of the interior pocket material and pull that material outside the pocket as the gloved hand is removed from the pocket. This action can spill the contents of the pocket, causing delays, potential loss of the pocket contents, and/or other difficulties. Constantly donning and doffing the golf glove also is inconvenient for the player, causes delays, and/or can lead to loss or misplacement of the glove.

Additionally, inserting and removing the gloved hand from the pocket can cause the securing mechanism of the glove to get caught and loosened, thereby requiring the golfer to again secure the glove on the hand. Such action also is inconvenient and causes delays.

Accordingly, advances in the golf glove art that help address at least some of these issues and alleviate at least some of these problems would be welcome.

Additionally, easy to use securing systems, closure systems, and the like would be welcome advances in those arts, including securing systems and closure systems that are capable of being manipulated and operated with one hand.

SUMMARY OF THE INVENTION

This Summary is provided to introduce some general concepts relating to this invention in a simplified form that are further described below in the Detailed Description. This Summary is not intended to identify key features or essential features of the invention.

Aspects of this invention relate to housings for releasable magnetic securing systems, e.g., for closure systems; for securing golf ball markers to golf gloves or other golf equipment, articles of clothing, etc.; and the like. Such housings may include, for example: (a) a base member including an outer perimeter; (b) a mount area defining a first base surface located at or within the outer perimeter of the base member, wherein the mount area includes at least one feature selected from the group consisting of: (i) the mount area defines a first receptacle for receiving a magnet or a ferromagnetic material, (ii) the mount area is at least partially made from a magnet, and (iii) the mount area is at least partially made from a ferromagnetic material; (c) at least two retaining walls (e.g., three, four, or even more walls) extending from or above the mount area above the first base surface and located at or within the outer perimeter of the base member. Interior surfaces of the retaining walls and the first base surface define a releasable member receptacle having an inner perimeter (e.g., a phantom line extending from, along, and interconnecting the interior surfaces of the retaining walls) for receiving a releasable member (e.g., a golf ball marker, a securing element for a closure system, etc.) to be held by magnetic force. In such housings, a combined total perimeter length of the interior surfaces of the retaining walls around the inner perimeter may be less than 50% of a total length of the inner perimeter and/or less than 50% of a total length of the outer perimeter of the object being releasably held, and in some examples, less than 40% of these total lengths or even less than 30% of these total lengths. The first base surface may include a planar portion that extends less than an entire interior area defined within the inner perimeter such that the planar portion does not extend all the way to at least some portion of the inner perimeter. A releasable connector, e.g., a golf ball marker, may be engaged with the housing by magnetic attractive forces.

Such assemblies may be incorporated, for example, into apparel (e.g., golf apparel, including clothing and shoes), sporting equipment (e.g., golf gloves, golf grips, and other golf equipment), closure systems, bags, containers, etc.

Additional aspects of this invention relate to gloves that include: (a) a glove member including an opening for receiving a wearer's hand; and (b) a closure system engaged with the glove member. This closure system may include: (i) a flap component including a first portion of a hook-and-loop fastener, wherein a first edge of the flap component is engaged with the glove member on a first side of the opening, and wherein the flap component further includes a free edge located opposite the first edge, and (ii) a base component including a second portion of the hook-and-loop fastener engaged with the glove member on a second side of the opening. An edge of the base component includes a notched area free of the second portion of the hook-and-loop fastener, wherein the free edge of the flap component extends over the notched area when the first and second portions of the hook-and-loop fastener are engaged together.

Closure systems of this type may be included on other types of objects, including articles of clothing, articles of footwear, sporting equipment, bags, containers, and/or other objects secured, engaged, or closed by a hook-and-loop fastener element.

BRIEF DESCRIPTION OF THE DRAWINGS

The foregoing Summary of the Invention, as well as the following Detailed Description of the invention, will be better understood when considered in conjunction with the accompanying drawings in which like reference numerals refer to the same or similar elements in all of the various views in which that reference number appears.

DETAILED DESCRIPTION OF THE INVENTION

Figure 1A:
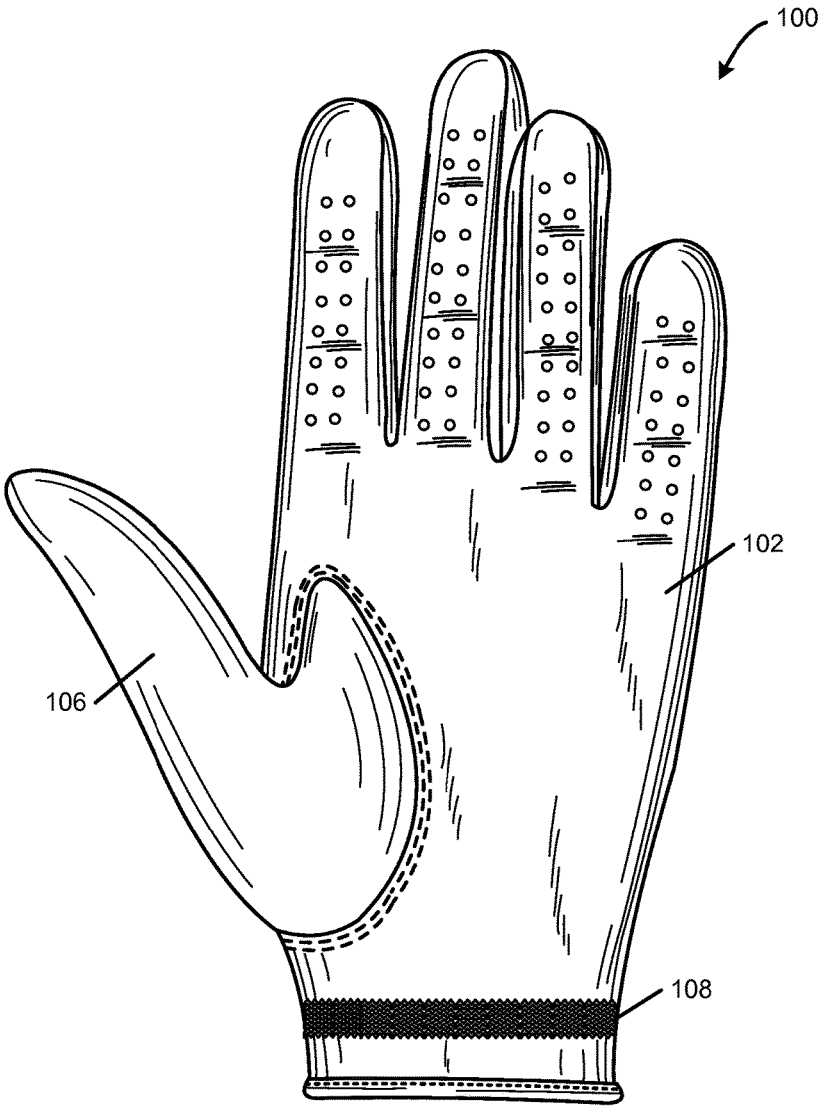
FIGS. 1A through 1H illustrate various views of a golf glove and/or various components of a releasable golf ball marker assembly in accordance with examples of this invention.

In the following description of various examples of magnetic engagement or securing systems according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and methods without departing from the scope of the present invention.

I. General Description of Aspects of this Invention

Aspects of this invention relate to magnetic engagement or securing systems, e.g., for use in releasably holding two components together. As noted above, more specific examples of aspects of this invention relate to magnetic engagement systems for attaching golf ball markers to other objects, such as golf gloves, other golf equipment, articles of apparel, etc. As other examples, aspects of this invention may be used for magnetic closure and/or securing mechanisms, e.g., for containers, as a replacement for buttons or snaps, for securing straps (e.g., for helmets, such as cycling helmets), etc. More specific features and aspects of this invention will be described in more detail below.

A. Magnetic Engagement System Housings in Accordance with Examples of this Invention Some aspects of this invention relate to housings for releasable magnetic securing systems, e.g., for closure systems; for securing golf ball markers to golf equipment, articles of clothing, etc.; and the like. Such housings may include, for example: (a) a base member including an outer perimeter; (b) a mount area defining a first base surface located at or within the outer perimeter of the base member, wherein the mount area includes at least one feature selected from the group consisting of: (i) the mount area defines a first receptacle for receiving a magnet or a ferromagnetic material, (ii) the mount area is at least partially made from a magnet, and (iii) the mount area is at least partially made from a ferromagnetic material; and (c) at least two retaining walls (e.g., three, four, or even more retaining walls) extending from and/or above the mount area above the first base surface and located at or within the outer perimeter of the base member. Interior surfaces of the retaining walls and the first base surface define a releasable member receptacle having an inner perimeter for receiving a releasable member (e.g., a golf ball marker, a securing element for a closure system, etc.) to be held by magnetic force. This inner perimeter may correspond to a phantom line extending around, along, and between the interior surfaces of the retaining walls. In such housings, a combined total perimeter length of the interior surfaces of the retaining walls around the inner perimeter may be less than 50% of a total length of the inner perimeter, and in some examples, less than 40% of this total length or even less than 30% of this total length. The first base surface may include a planar portion that extends less than an entire interior area defined by the inner perimeter such that the planar portion does not extend all of the way to at least some portion of the inner perimeter.

If desired, at least some portions of the housing may be formed as a unitary, one-piece construction (e.g., including any or all of the base member, the mount area and/or the retaining walls). Alternatively, the housing may be made from two or more separate parts that are engaged together. The housing (including any of the parts identified above) may be made from a flexible material, such as a flexible rubber or polymer material, optionally a thermoplastic polyurethane material, and made by molding processes, such as injection molding.

As noted above, the first base surface may include a planar portion that extends less than an entire interior area defined by the inner perimeter such that the planar portion does not extend all of the way to at least some portion of the inner perimeter. The planar portion may engage the object to be held when it is mounted in the mount area. The planar portion may stop short of at least some portion of the inner perimeter of the releasable member receptacle, e.g., by providing a through hole (through the housing) within the inner perimeter, by providing a step portion within the inner perimeter, by providing a curved or slanted wall within the inner perimeter, etc.

B. Glove Ball Marker Assemblies and Products Incorporating Such Assemblies in Accordance with Examples of this Invention Additional aspects of this invention relate to golf ball marker assemblies. Such assemblies may include: (a) a base member including an outer perimeter; (b) a mount area defining a first base surface located at or within the outer perimeter of the base member, wherein the mount area includes at least one feature selected from the group consisting of: (i) the mount area defines a first receptacle for receiving a magnet or a ferromagnetic material, (ii) the mount area is at least partially made from a magnet, and (iii) the mount area is at least partially made from a ferromagnetic material; (c) at least two retaining walls extending from the mount area above the first base surface and located at or within the outer perimeter of the base member, wherein interior surfaces of the retaining walls and the first base surface define a golf ball marker receptacle; and (d) a golf ball marker removably receivable in the golf ball marker receptacle and removably secured to the mount area by magnetic forces (e.g., magnetic attraction between at least some portion of the mount area and at least some portion of the golf ball marker), wherein the golf ball marker has an outer perimeter. In such assemblies, a combined total perimeter length of the interior surfaces of the retaining walls may extend less than 50% of the outer perimeter of the golf ball marker, and in some examples, less than 40% of this outer perimeter or even less than 30% of this outer perimeter. The first base surface may include a planar portion that extends less than an entire interior area of the golf ball marker receptacle (and/or an inner perimeter defined by the interior surfaces of the retaining walls) such that the planar portion does not extend to at least some portion of an outer edge of the golf ball marker receptacle (e.g., to the inner perimeter, (e.g., as described above)). The assembly may have any of the various features described above for the housing.

Golf ball marker assemblies of the types described above may be incorporated into a variety of structures without departing from this invention. For example, golf apparel may include the housings described above (e.g., the base members described above engaged with some portion of the article of apparel). Examples of such golf apparel include: a hat or visor (e.g., with the base member mounted on a visor component of the hat or visor); a pair of pants or shorts, a shirt, a jacket, a rain jacket, a pair of rain pants, a windshirt or wind breaker (e.g., optionally with the base member mounted at or near a pocket edge location of the article of apparel, including within an interior compartment of the pocket); a shoe (e.g., with the base member mounted at a tongue portion of the shoe, on the shoe upper, etc.); a belt (e.g., with the base member mounted on a belt buckle or strap); on a watch band or other wrist borne device; etc.

As additional examples, golf ball marker assemblies of the types described above may be incorporated into golf equipment of various types. For example, golf equipment may include the housings described above (e.g., the base members described above engaged with some portion of the golf equipment (also called a "golf equipment base component" herein)). Examples of such golf equipment include: divot repair tools; golf gloves (e.g., with the base member included on a flap of a closure system of the glove); golf bags; golf carts; golf club grips (e.g., putter grips); putter heads (e.g., a top or bottom surface of a putter); golf yardage measuring devices (e.g., laser distance measuring devices, GPS devices, etc.); etc.

C. Releasable Magnetic Securing Assemblies and Products Incorporating Such Assemblies in Accordance with Examples of this Invention Still additional aspects of this invention relate to other releasable magnetic securing assemblies that may include housings, base members, mount areas, and retaining walls of the types described above. The housings or base members may be engaged with one component that is to be engaged with another component. The other component may be (or may have attached to it) a connector component that is removably receivable in a connector receptacle of the base member (e.g., the connector receptacle being defined by the first base surface and the retaining walls). Magnetic attraction between the mount area of the base member and the connector component releasably holds the two components together. Such securing assemblies may function as closure systems (e.g., closure flaps for boxes, bags, or other containers; replacements for buttons, snaps, or hook-and loop type connectors, etc.; etc.). Such securing assemblies may be easily manipulated and used, e.g., even with a single hand and/or a gloved hand.

D. Hook-And-Loop Fastener Systems for Securing Gloves and Other Objects

Still additional aspects of this invention relate to securing systems, such as closure systems for gloves or other articles of apparel or objects, including golf gloves and other hand-receiving devices. Such securing systems may include: (a) a flap component including a first portion of a hook-and-loop fastener, wherein a first edge of the flap component is engaged (directly or indirectly) with a first portion of an item to be secured (e.g., on a first side of an opening in a glove for receiving a wearer's hand), and wherein the flap component further includes a free edge located opposite the first edge, and (b) a base component including a second portion of the hook-and-loop fastener engaged with a second portion of an item to be secured (e.g., on the other side of the glove opening), wherein an edge of the base component includes a notched area free of the second portion of the hook-and-loop fastener, and wherein the free edge of the flap component extends over the notched area when the first and second portions of the hook-and-loop fastener are engaged together. The notched area provides a grasping area to help in releasing the securing system.

The hook-and-loop fastener may be of any desired type, including low profile or even ultra-low profile hook-and-loop fastener components (e.g., thin hook-and-loop fasteners, optionally wherein the first and second portions of the hook-and-loop fastener, when engaged together, have an overall thickness of less than ⅜ inch thick, less than ¼ inch thick, less than 3/16 inch thick, or even less than ⅛ inch thick).

In such structures, the notched area may include the base component but not the second portion of the hook-and-loop fastener. Alternatively, if desired, the notched area need not include the base component. As other potential features, a portion of the free edge of the flap component that extends over the notched area may include some of the first portion of the hook-and-loop fastener or this portion of the free edge may be free of the first portion of the hook-and-loop fastener.

The notched area may take on any desired shape or construction without departing from this invention. For example, the notched area may be centered along the edge of the base component or it may be offset to one end or the other of this edge. The notch may be defined by a smoothly curved edge of the base component (or at least a portion of this edge) or by more squared or abrupt corners including square corners).

In some example structures in accordance with this aspect of the invention, the first portion of the hook-and-loop fastener will cover at least 90% (and in some examples, at least 95% or even at least 98%) of a major surface of the flap component, and the second portion of the hook-and-loop fastener will cover at least 90% (and in some examples, at least 95% or even at least 98%) of a major surface of the base component. In such structures, the notched area may be defined by an inward curvature of the edge of the base component. In other example structures, the first portion of the hook-and-loop fastener will cover at least 90% (and in some examples, at least 95% or even at least 98%) of a major surface of the flap component, and the second portion of the hook-and-loop fastener will cover less than 95% (and in some examples, less than 90% or even less than 85%) of a major surface of the base component. In such structures, the notched area may be defined by an inward curvature of the second portion of the hook-and-loop fastener along the edge of the base component (to thereby leave a portion of the major surface of the base component along the edge free of the second portion of the hook-and-loop fastener).

As yet additional examples, the first portion of the hook-and-loop fastener may extend to and along the free edge of the flap component, the second portion of the hook-and-loop fastener may extend to and along the edge of the base component, and the notched area may be defined by an inward curvature of the edge of the base component. Alternatively, the first portion of the hook-and-loop fastener may extend to and along the free edge of the flap component, the second portion of the hook-and-loop fastener may extend to a top portion of the edge of the base component and to a bottom portion of the edge of the base component, and the second portion of the hook-and-loop fastener does not extend to the edge of the base component for a portion of the edge between the top portion and the bottom portion to thereby define the notched area.

Closure or securing systems of this type may be included on other types of objects, including articles of clothing, articles of footwear, sporting equipment, bags, containers, cases, and/or other objects engaged or closed by a hook-and-loop fastener element.

Given the general description of features, aspects, structures, and arrangements according to the invention provided above, a more detailed description of specific example components in accordance with this invention follows.

II. Detailed Description of Example Structures According to this Invention

Referring to the figures and following discussion, various securing structures and features thereof in accordance with the present invention are disclosed. The structures depicted and discussed may be applied to a wide range of products, e.g., like those described above. Accordingly, the present invention is not limited to the precise embodiments disclosed herein.

Figure 1B:
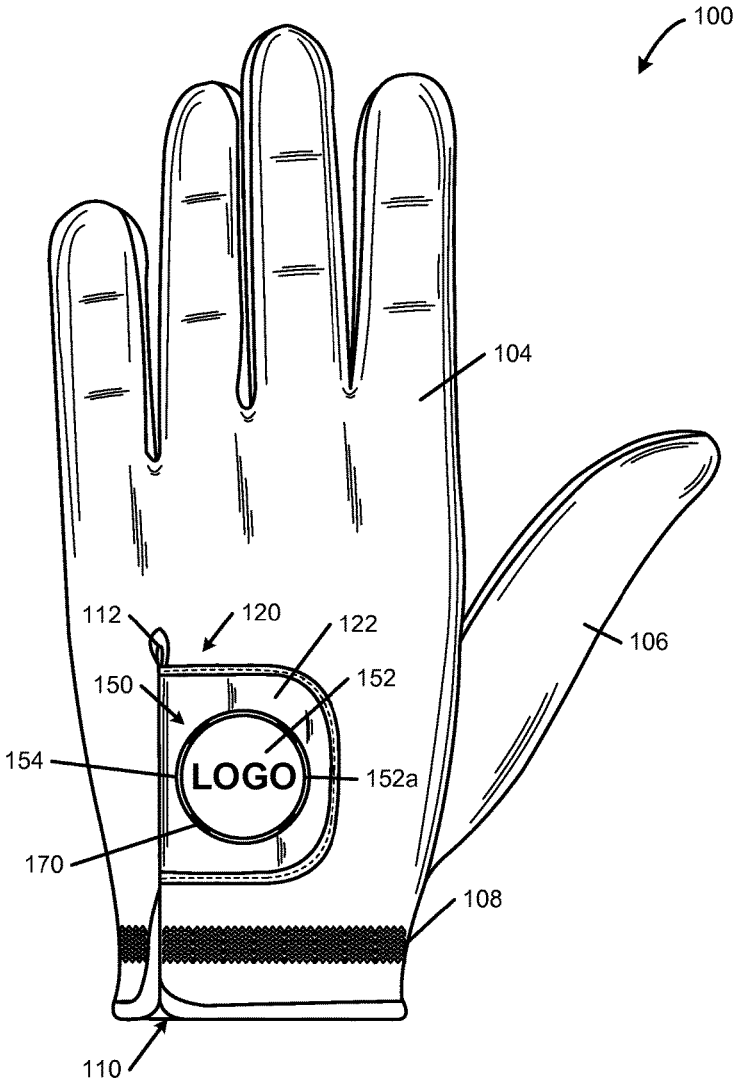
Figure 1C:
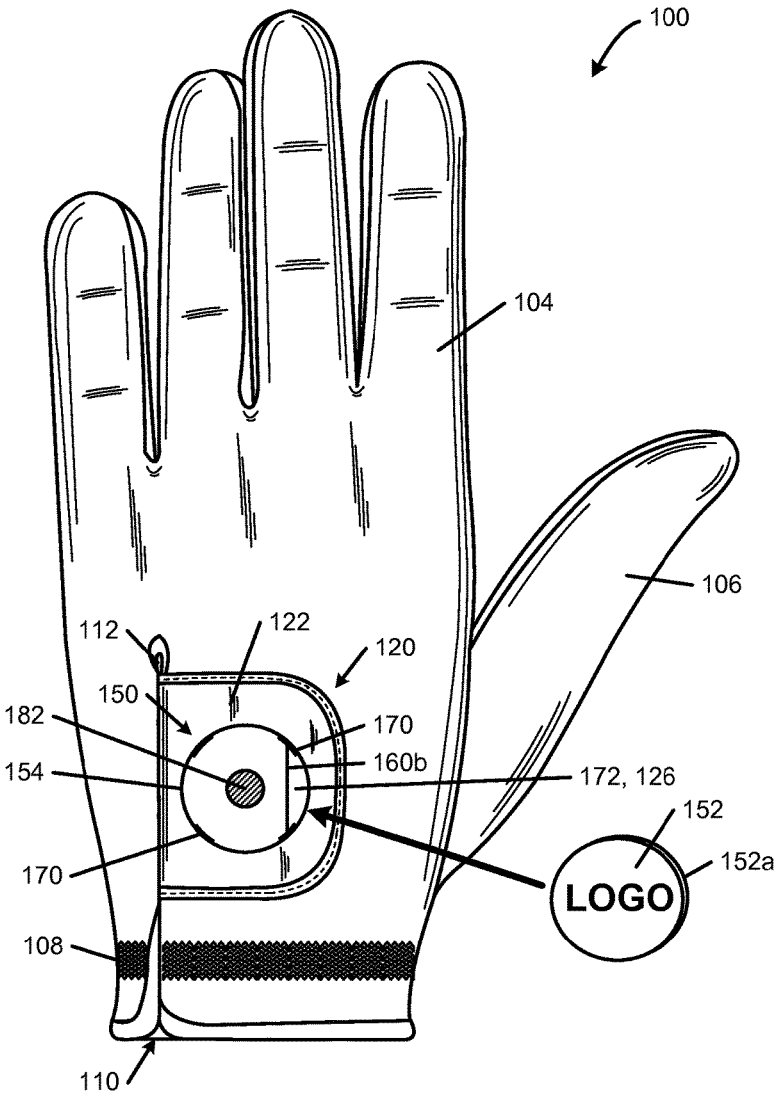

FIGS. 1A through 1C illustrate an example golf glove structure 100 that includes a magnetic securing assembly 150 for engaging a golf ball marker 152 with the golf glove 100. In such assemblies 150, at least one of the marker 152 or at least some portion of the structure for holding it (as will be described in more detail below) will be made from a magnet (e.g., a permanent magnet). Optionally, one or both of the marker 152 and at least some portion of the structure for holding it will be made from a material that is attracted to the magnet by magnetic force (e.g., a ferromagnetic material). The golf ball marker 152 may be a thin cylindrical element (e.g., coin shaped).

As is conventional, as shown in FIGS. 1A and 1B, the glove 100 includes a front portion 102 and a rear portion 104, each made from any desired material with any desired construction and/or any desired number of individual parts (e.g., natural or synthetic leather materials, polymeric fabric materials, stretchable materials, etc.). In this illustrated example, the front portion 102 and the rear portion 104 are engaged together, e.g., by sewing or stitching, and a thumb portion 106 (constructed from one or more parts) is engaged with the front portion 102 by sewing or stitching. If desired, the glove structure 100 may include additional individual parts, such as gussets for the sides of the fingers, an elastic element 108 along the wrist area of glove opening 110, stretch panels across the rear knuckle region or fingers, mesh material for breathability, etc.

FIGS. 1B and 1C further show that this example glove construction 100 includes a closure system 120 for closing the glove opening 110 and securing the glove 100 to a wearer's hand. While a variety of constructions are possible without departing from this invention, in this illustrated example, the closure system 120 includes a flap 122 engaged with the rear portion 104 on one side of a slit 112 that forms part of the glove opening 110. The flap 122 may include one portion of a releasable connector system (e.g., a button, a button hole, a portion of a snap, a portion of a hook-and-loop fastener system, etc.) that engages another portion of the releasable connector system, e.g., that may be mounted on the rear portion 104 of the glove structure 100. The flap 122 may be engaged with the remainder of the glove structure 100 (e.g., at the seam where the front portion 102 and the rear portion 104 are joined together) via an elastic element that allows the flap 122 to be pulled and secured by the user at the desired level of tightness.

Figure 1D:
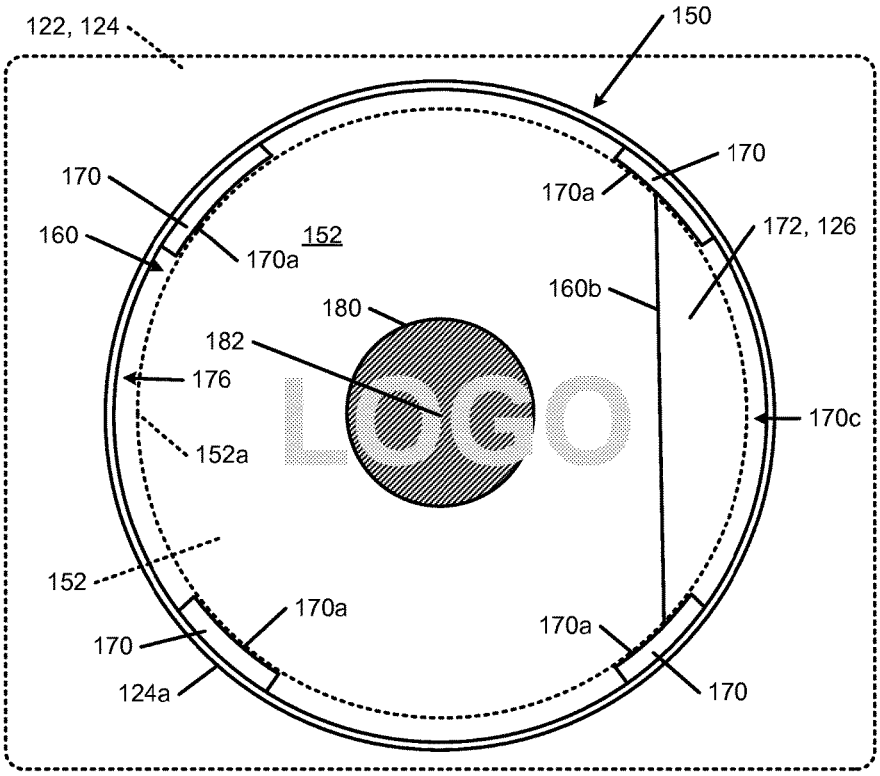
Figure 1E:
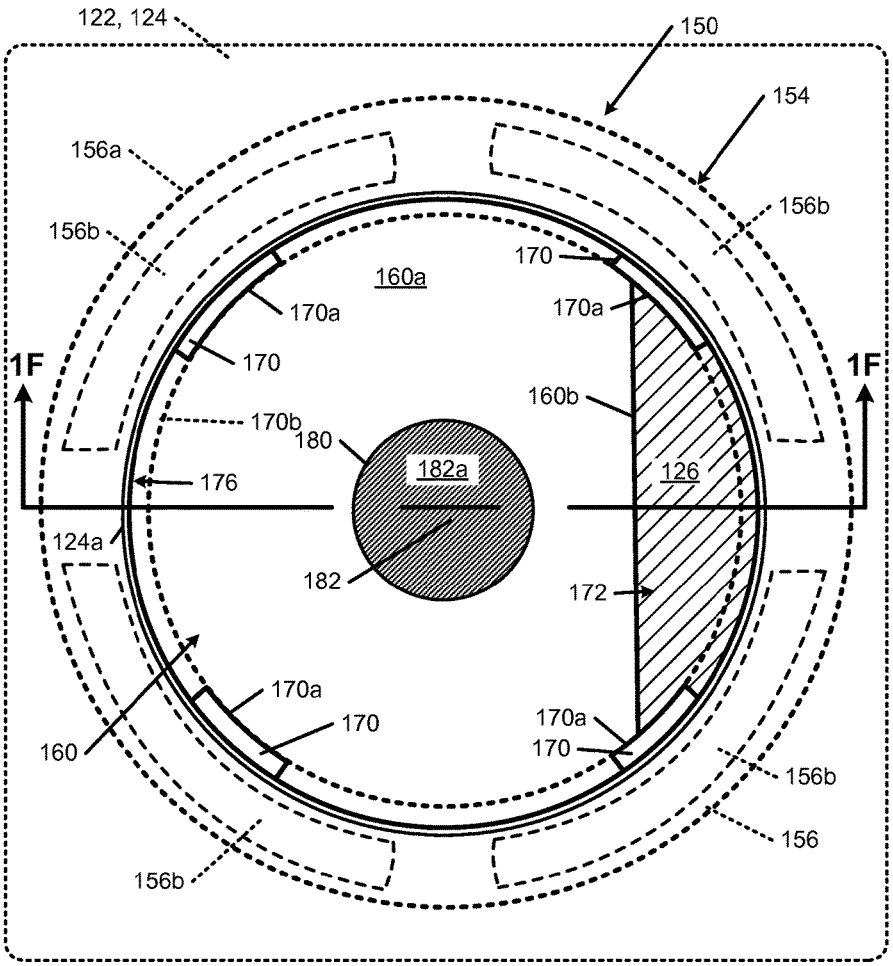
Figure 1F:
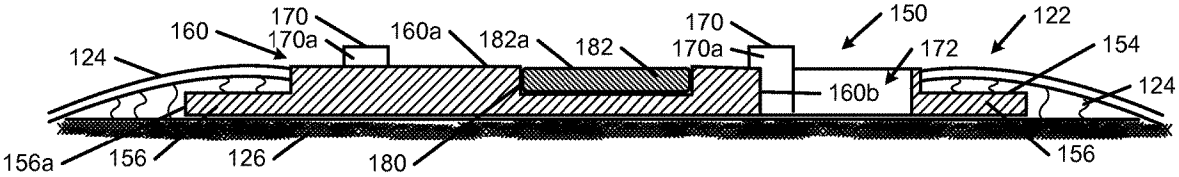
Figure 1G:
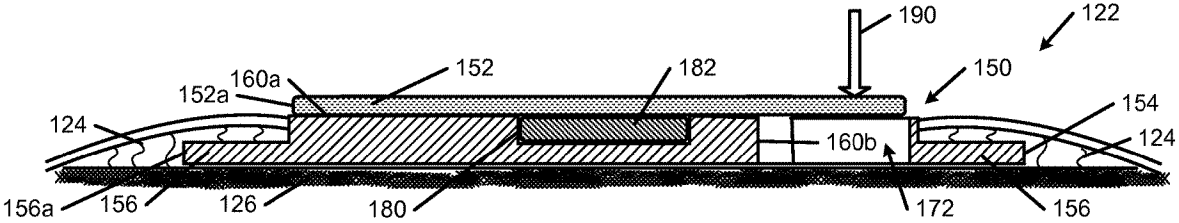
Figure 1H:
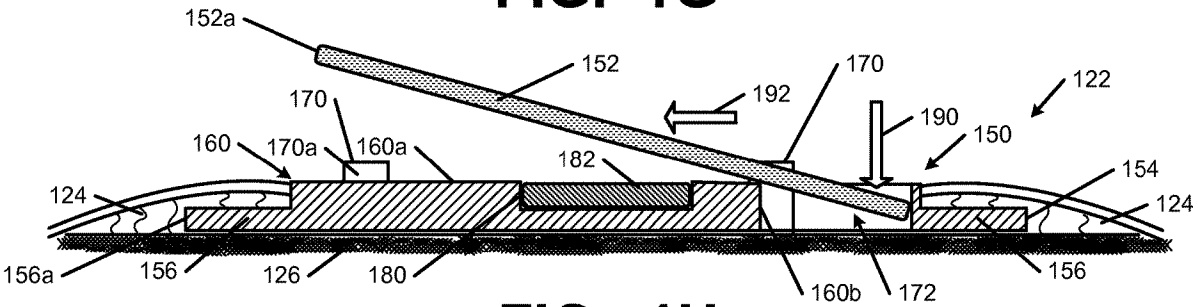

FIGS. 1B and 1C, along with FIGS. 1D through 1H, illustrate further details of the magnetic securing assembly 150 for releasably engaging the golf ball marker 152 with the golf glove 100. FIG. 1D shows a close up view of the securing assembly 150 mounted to the glove flap 122 with the marker 152 outer perimeter 152*a* provided in broken lines and for context. FIG. 1E shows a close up view of the securing assembly 150 with the marker 152 removed in which certain hidden features of this example assembly are shown in broken lines. FIGS. 1F through 1H show cross sectional views of the flap 122 and securing assembly 150 combination to illustrate the function of this example of the invention.

In this illustrated example, a housing or base member 154 for the magnetic securing assembly 150 is engaged with the flap 122 of the glove closure system 120. An outer flange 156 of the housing 154 (having outer perimeter 156*a*) is secured between a leather (or other fabric) top layer 124 of the flap 122 and a portion 126 of a hook-and-loop fastener element used to secure the flap 122 to the other portion of the hook-and-loop fastener element. A portion of the housing 154 is exposed through an opening 124*a* in the top layer 124 of the flap. In some example structures in accordance with this invention, the flange 156 will be made from a flexible material, e.g., rubber, thermoplastic polyurethane, other polymers, etc., so that it may flex somewhat, e.g., as the wearer's hand also flexes, to better conform to the shape of the hand, to provide better comfort, etc. The flange 156 is engaged with the top layer 124 by stitching or sewing. Adhesives or other connecting mechanisms may be used for this engagement without departing from this invention (e.g., gluing the housing 154 to the top layer 124 or the fastener element portion 126).

The housing or base member 154 further includes a mount area 160 (exposed through the opening 124*a* of the top layer 124) that defines an at least partially exposed base surface 160*a* on which the ball marker 152 is releasably mounted. As best shown in FIGS. 1F through 1H, the base surface 160*a* includes a planar portion on which the marker 152 rests when secured to the mount area 160.

FIGS. 1B through 1H further show that the securing assembly 150 of this example construction includes at least two retaining walls 170 that extend from or above the mount area 160 and above the base surface 160*a* (four walls 170 are shown in this illustrated example structure). In this illustrated example, interior or facing surfaces 170*a* of the retaining walls 170 and the base surface 160*a* define a golf ball marker receptacle, e.g., the walls 170 are located and their interior surfaces 170*a* are shaped so as to closely fit around the outer perimeter edge 152*a* of the golf ball marker 152. The retaining walls 170 are sized such that a total length of the perimeter of the interior surfaces 170*a* of all the retaining walls 170 defining the golf ball marker receptacle is less than 50% of the outer perimeter 152*a* of the golf ball marker 152 to be held within the receptacle, and in some examples, less than 40% or even less than 30% of this outer perimeter 152*a* length. Additionally or alternatively, the retaining walls 170 may be sized such that a total length of the perimeter of the interior surfaces 170*a* of all the retaining walls 170 defining the golf ball marker receptacle is less than 50% of the perimeter length defined by extending the interior surfaces 170*a* of the retaining walls 170 between the walls 170 to define an inner perimeter making up the golf ball marker receptacle (see the interior perimeter extension or the "phantom inner perimeter" 170*b* shown in FIG. 1E). In some examples, the total (actual) interior perimeter length of the interior surfaces 170*a* will be less than 40% or even less than 30% of than of this phantom inner perimeter 170*b* length.

The short retaining walls 170 (in the inner perimeter direction) and their dispersed distribution around the mount area 160 help securely hold the ball marker 152 in place on the base surface 160*a* while still allowing for easy engagement and disengagement of the ball marker 152 with respect to the base surface 160*a*. As will become more clear in the discussion that follows with respect to FIGS. 1F through 1H, the relatively large gaps between separate retaining walls 170 allows the marker 152 to be more easily grabbed and/or more easily slid in a variety of different directions onto and off of the base surface 160*a*.

As noted above, the base surface 160*a* includes a planar portion on which the marker 152 rests when secured to the mount area 160. This planar portion may extend to less than an entire interior area of the inner perimeter 170*b* defined by the extension of the retaining walls 170 (the phantom perimeter) such that at least some of the planar portion does not extend to at least some portion of the inner perimeter 170*b*. In the example structure shown in FIGS. 1C through 1H, the planar portion of the base surface 160*a* ends at transverse or side wall 160*b* located within the inner perimeter 170*b* (the wall 160*b* could extend at a non-perpendicular angle to the planar portion of the base surface 160*a* or as a curved surface, if desired). Therefore, in this illustrated example structure, the housing or base member 154 has a through hole 172 defined through it. At least a majority of this through hole 172 is located within an area defined by the retaining walls 170 (i.e., within phantom inner perimeter 170*b*). In the view shown in FIG. 1E, the shaded portion represents the location of the through hole 172, and the underside of the hook-and-loop fastener portion 126 is visible through the through hole 172. While a single through hole 172 is shown in inner perimeter 170*b* in this illustrated example, multiple through holes could be provided in inner perimeter 170*b*, if desired, without departing from this invention.

The planar portion of the base surface 160*a* on which the marker 152 rests when secured to the housing 154 may take up any desired proportion of the inner perimeter 170*b* without departing from this invention, provided a stable support surface is provided. As some more specific examples, the planar portion of the base surface 160*a* may take up from 15% to 95% of the area of the inner perimeter 170*b*, and in some examples, from 20% to 90%, from 25% to 80%, or even from 30% to 75% of this area. When one or more through holes 172 are present through the mount area 160, these through holes may take up from 5% to 85% of the area of the inner perimeter 170*b*, and in some examples, from 10% to 80%, from 20% to 75%, or even from 25% to 70% of this area. In some examples, a single through hole 172 may take up from 10% to 25% of the area of the inner perimeter 170*b*. Through holes of these types can lighten the weight of the housing 154 and/or improve its flexibility.

The base surface 160*a* also may include one or more recessed portions in it such that the base surface 160*a* (and particularly its planar portion) is not continuous or uninterrupted (e.g., by forming recessed holes (blind or through holes) or grooves or other shapes in the base surface 160*a*). Such recessed portions also can help lighten the weight of the housing 154 and/or improve its flexibility. Similarly, as shown in FIG. 1E, the flange 156 of the housing or base member 154 also may include recessed portions or openings 156*b*, which also can help lighten the weight of the housing 154 and/or improve its flexibility.

In this illustrated example structure 150, two of the retaining walls 170 are located at positions such that their interior surfaces 170*a* bridge the locations where the base surface 160*a* of the mount area 160 lies adjacent or meets the through hole 172 (e.g., two of the walls 170 bridge the locations of the side wall 160*b*). In this arrangement, a gap 170*c* exists adjacent the through hole 172 between two of the retaining walls 170. This gap 170*c* allows for better access to the marker 152 at the hole location 172 to disengage the marker 152 from the base surface 160*a* as will be explained in more detail below in conjunction with FIGS. 1F through 1H.

While discussed above separately, if desired, any portions of the securing system 150 may be made from a single material and/or as a unitary, one-piece construction. For example, the housing 154, optionally including the flange 156, the mount area 160, the base surface 160*a* (including any planar portion and other portion(s) not co-planar with the planar portion), the side wall 160*b*, and/or the retaining walls 170, may be formed as a unitary, one-piece construction. As a more specific example, any desired number or combination of these elements may be formed as a unitary, one-piece construction, e.g., from a flexible polymer material (such as rubber, TPU, or the like, and optionally a material that can be stitched through) in a molding step (e.g., injection molding).

As described above, this securing assembly is used for magnetically engaging a golf ball marker 152 with the housing or base member 154. Accordingly, at least one of these components must be made from or made to include a magnet, e.g., a permanent magnet. As some more specific examples, the mount area 160 may be formed so as to include at least one feature selected from the group consisting of: (a) the mount area 160 defines a first receptacle (which may be a blind or an open hole) for receiving a magnet 182 or a ferromagnetic material, (b) the mount area 160 is at least partially made from a magnet, and/or (c) the mount area 160 is at least partially made from a ferromagnetic material. Likewise, the marker 152 may be formed so as to include at least one feature selected from the group consisting of: (a) the marker 152 defines a receptacle (which may be a blind or an open hole) for receiving a magnet or a ferromagnetic material, (b) the marker 152 is at least partially made from a magnet, and/or (c) the marker 152 is at least partially made from a ferromagnetic material. In this illustrated example, the mount area 160 includes a receptacle 180 formed therein into which a magnet 182 is mounted (e.g., bonded by adhesives). If the mount area 160 is made from or includes a magnet 182, then the marker 152 optionally may be made, at least in part, from a material that is attracted to a magnet 182 (although it also could be made from or include a magnet). If the marker 152 is made from or includes a magnet, then the mount area 160 optionally may be made, at least in part, from a material that is attracted to a magnet.

If desired, one surface 182*a* of the magnet 182 may be exposed at the housing 154 exterior and lie co-planar with or substantially co-planar with the base surface 160*a* on which the marker 152 is mounted. As other alternatives, if desired: (a) the magnet's surface 182*a* may lie somewhat below the surface of the base surface 160*a*, (b) the magnet 182 may be inserted into the mount area from an opening on the bottom side (so that the magnet 182 is not exposed in the final configuration when the marker 152 is removed from the base area 160*a*), or (c) the magnet 182 may be embedded within the body of the mount area 160.

FIGS. 1F through 1H illustrate mounting and disengagement of the golf ball marker 152 on the base surface 160*a* of the housing 154. A ball marker receiving receptacle is defined by the base surface 160*a* (at least a planar portion thereof) and the interior surfaces 170*a* of the retaining walls 170, which may be dispersed around the mount area 160 of the housing 154. A ball marker 152 in the shape of a cylinder (round or other cross sectional shape) or coin is mounted on the base surface 160*a* and held in place by the retaining walls 170, as shown in FIGS. 1D and 1G and by magnetic attraction forces. Because the planar portion of the base surface 160*a* supports a sufficient area portion of the marker 152, the marker 152 rests comfortably and securely on the base surface 160*a*, and it is not easily subjected to dislodgement inadvertently or in an unintentional manner.

When it is desired that the ball marker 152 be removed from the mount area 160, the user presses downward on the marker 152 over the area of the through hole 172, as shown by force arrow 190 in FIG. 1G. Sufficient downward force on the side of the marker 152 will cause the marker 152 to rotate upward, e.g., using the edge at the side wall 160*b* as a fulcrum, thereby raising the far end of the marker 152 above the level of the remote retaining wall(s) 170. See FIG. 1H. The short perimeter lengths and the discontinuous nature of the retaining wall(s) 170, particularly those located opposite the side with the through hole 172, provide additional room through which the user can grasp the raised edge of the marker 152 (e.g., the gap 176 between retaining walls 170 at the side of the marker 152 opposite the through hole 172 provides additional room for the user to grab the marker 152). Additionally or alternatively, the short perimeter lengths, the short heights, and the discontinuous nature of the retaining wall(s) 170 allow the marker 152 to be slid horizontally more easily (shown by arrow 192 in FIG. 1H), which can also help dislodge the marker 152 from the mount area 160. The ball marker 152 can be easily re-engaged by aligning the ball marker 152 within the inner perimeter area 170*b* defined between walls 170 (magnetic attraction between the ball marker 152 and the mount area 160 helps engage these elements and properly seat the ball marker 152 on the mount area 160). If necessary, the marker 152 can be slid along the tops of two or more retaining walls 170 until it is centered over the mount area 160.

In at least some example structures according to this invention, at least some (and in some examples all) of the individual retaining walls 170 will have inner surfaces 170*a* having a perimeter length of less than 15% of the phantom inner perimeter 170*b* length and/or less than 15% of the marker 152 outer perimeter 152*a* length. The inner surfaces 170*a* of at least some of the individual retaining walls 170 (and in some examples, all of the retaining walls 170 in a housing) will have a perimeter length of less than 10% of the phantom inner perimeter 170*b* length and/or less than 10% of the marker 152 outer perimeter 152*a* length.

Figure 2A:
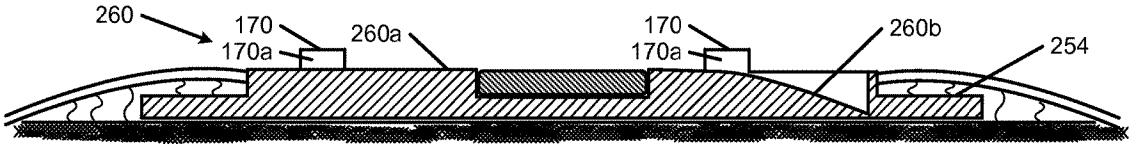
FIGS. 2A through 2C illustrate cross sectional views of an alternative golf ball marker assembly in accordance with examples of this invention.
Figure 2B:
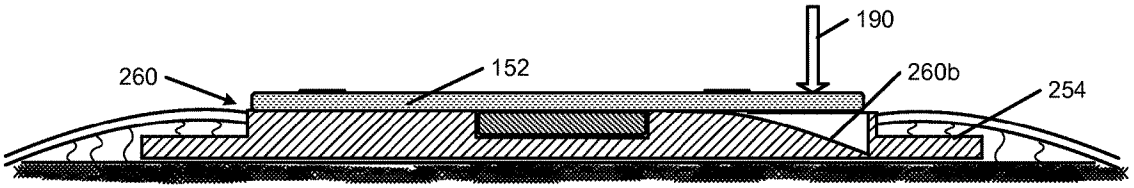
Figure 2C:
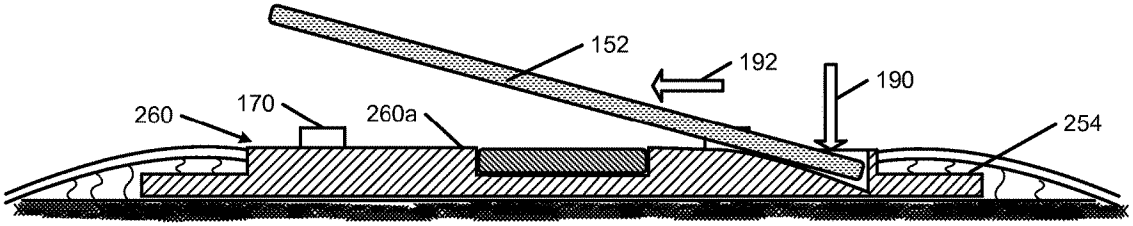

Many variations in ball marker securing assemblies of this type are possible without departing from this invention. For example, as noted above, in the illustrated example of FIGS. 1A through 1H, the receptacle for holding the marker 152 is defined by the mount area 160 (e.g., including a planar portion of base surface 160*a*) and the inner surfaces 170*a* of retaining wall(s) 170, and a through hole 172 is defined through a portion of this receptacle (which exposes the lower flap layer 126 through the mount area 160). There is no requirement that the mount area 160 include a through hole 172. FIGS. 2A through 2C (which are similar to FIGS. 1F through 1H described above) provide an example of such a housing 254 and mount area 260 construction. In this example housing 254, the base surface 260*a* still has a planar portion (e.g., at the left side of these figures), but at one edge, the base surface 260*a* turns downward into an inclined or curved portion 260*b*. The transition location from the planar portion for supporting the marker 152 to the inclined or curved portion 260*b* may be gradual and smooth or more abrupt (e.g., with a definite edge). This transition may take place at any desired location across the marker's dimension provided an adequate supporting surface is provided for securely holding the marker 152 under magnetic attraction forces (e.g., where the planar portion of the base surface 260*a* extends across at least 70% of the area within the phantom inner perimeter 170*b* defined by the interior surfaces 170*a* of the retaining walls 170).

FIGS. 2B and 2C illustrate mounting and removal of the marker 152 from the mount area 260, e.g., which may take place in manners similar to those shown and described above in conjunction with FIGS. 1G and 1H.

Figure 3:
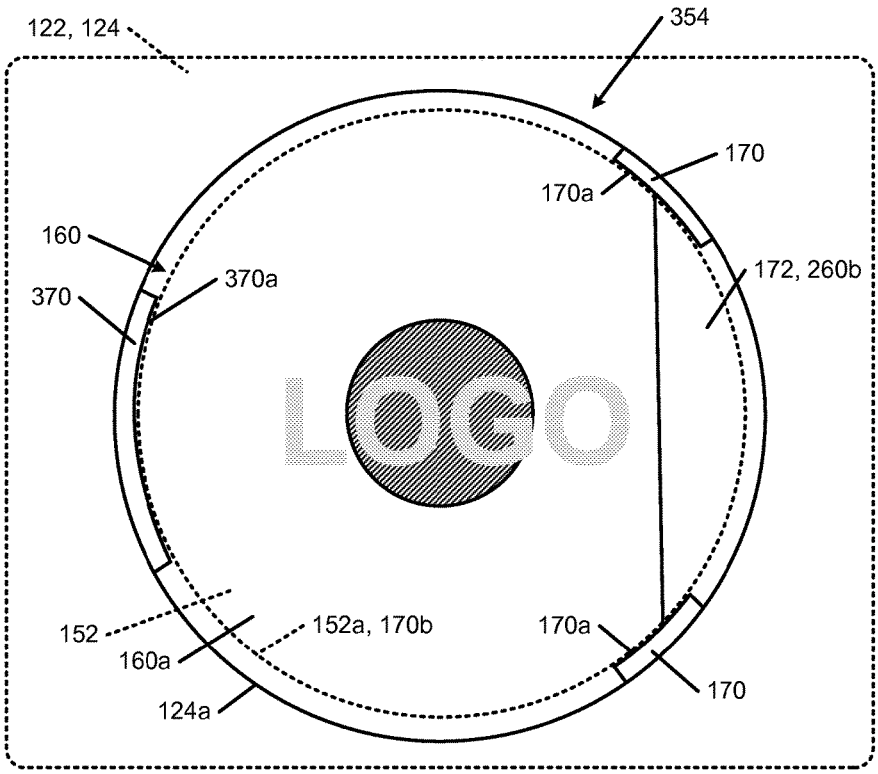
FIG. 3 illustrates an overhead view of another example golf ball marker assembly in accordance with examples of this invention.

Other variations are possible without departing from this invention. As another example, the number of retaining walls need not be four as shown in FIGS. 1B through 1H. FIG. 3 shows one example (when the same reference numbers are used in FIG. 3 as used in other figures, the same or a similar part is represented, and a detailed discussion may be omitted). More specifically, FIG. 3 shows a portion of a housing construction 354 in which the two retaining walls 170 located remote from the opening 172 (or remote from non-coplanar portion 260*b*) are replaced with a single retaining wall 370 (having inner surface 370*a*) such that the overall housing 354 has three total retaining walls. While not required, this retaining wall 370 may be located directly opposite and centered on the opening 172 (or on the non-coplanar portion 260*b* of the mount area). Also, while the retaining wall 370 is shown as having a longer inner surface 370*a* perimeter length than the other walls 170, wall 370 could be the same length as or shorter than walls 170 (which may have the same or different perimeter lengths from one another). The total perimeter length of the inner surfaces 170*a* and 370*a* may be less than 50% of the phantom perimeter length 170*b* and less than 50% of the marker outer perimeter 152*a* length (and in some examples, less than 40% or even less than 30% of these perimeter lengths).

Notably, in this example structure 354, the inner surfaces 170*a* and 370*a* of the retaining walls 170 and 370 are shaped such that continuous extensions thereof define a "phantom" inner perimeter 170*b*, and this phantom inner perimeter 170*b*, together with the base surface 160*a*, defines a receptacle for receiving the marker 152. Also, the phantom inner perimeter 170*b* closely aligns with and fits around the outer perimeter 152*a* of the marker 152. Also, in this example structure, two retaining walls 170 are provided at and bridge the location where the planar portion of the base surface 160*a* meets the opening 172 (side wall 160*b*) or where the planar portion of the base surface 160*a* transitions to the non-coplanar portion 260*b*.

Figure 4:
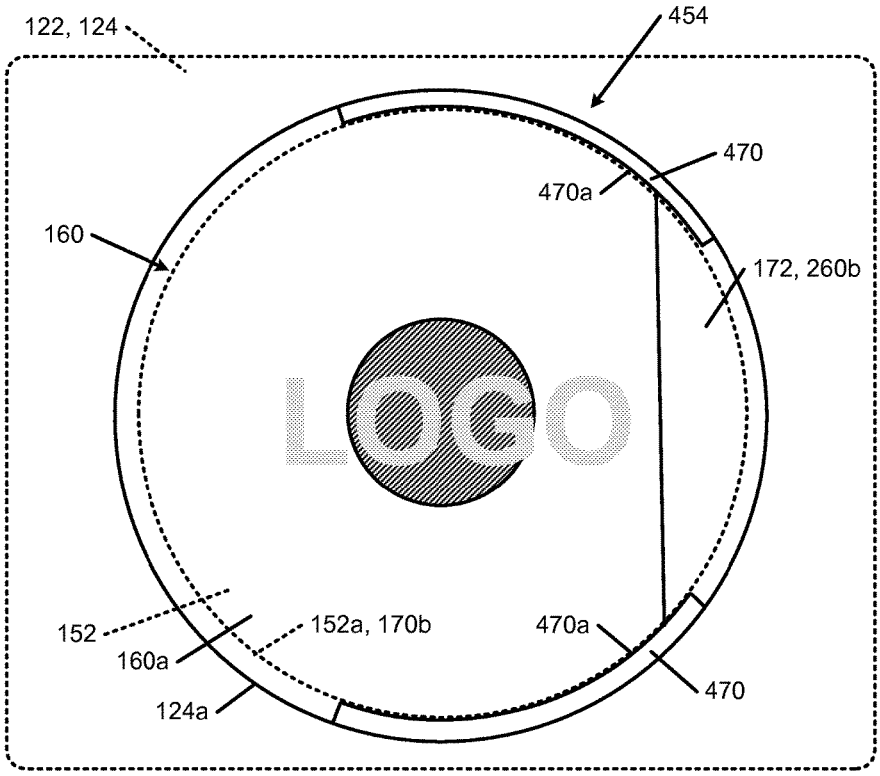
FIG. 4 illustrates an overhead view of still another example golf ball marker assembly in accordance with examples of this invention.

FIG. 4 shows another example housing construction 454 in which a total of two retaining walls 470 are provided (having inner surfaces 470*a*). Like the other examples described above, in this example structure 454, the inner surfaces 470*a* of the retaining walls 470 are shaped such that continuous extensions thereof define a "phantom" inner perimeter 170*b*, and this phantom inner perimeter 170*b*, together with the base surface 160*a*, defines a receptacle for receiving the marker 152. Also, the phantom inner perimeter 170*b* closely aligns with and fits around the outer perimeter 152*a* of the marker 152. The total perimeter length of the inner surfaces 470*a* may be less than 50% of the phantom perimeter length 170*b* and less than 50% of the marker outer perimeter 152*a* (and in some examples, less than 40% or even less than 30% of these perimeter lengths).

Also, in this example structure, the two retaining walls 470 are provided at and bridge the location where the planar portion of the base surface 160*a* meets the opening 172 (side wall 160*b*) or where the planar portion of the base surface 160*a* transitions to the non-coplanar portion 260*b*. The retaining walls 470 need not be centered with respect to one another on opposite sides about the phantom inner perimeter 170*b* and/or the marker outer perimeter 152*a*. In other words, the gap between the edges of the two walls 470 at one side may be greater than the gap between the edges of the two walls at the other side. The walls 470 may be of the same or different sizes (e.g., perimeter lengths) without departing from this invention.

In the above discussion relating to FIGS. 1A through 4, the golf ball marker housing is disclosed as being mounted on a flap 122 of a closure system 120 for a golf glove 100. Other arrangements are possible without departing from this invention. For example, rather than on a flap, the housing 154, 254, 354, or 454 described above could be mounted on a rear panel or on the rear portion 104 of the golf glove 100 (e.g., if the glove does not include a closure flap 122 of the type described above). As additional examples, if desired, the housings 154, 254, 354, and 454 may be mounted on other articles of golf apparel or other items of golf equipment without departing from this invention (so that the ball marker 152 may be secured on these other articles of apparel or items of equipment). Examples of such variations will be described in more detail below in conjunction with FIGS. 5 through 9.

Figure 5:
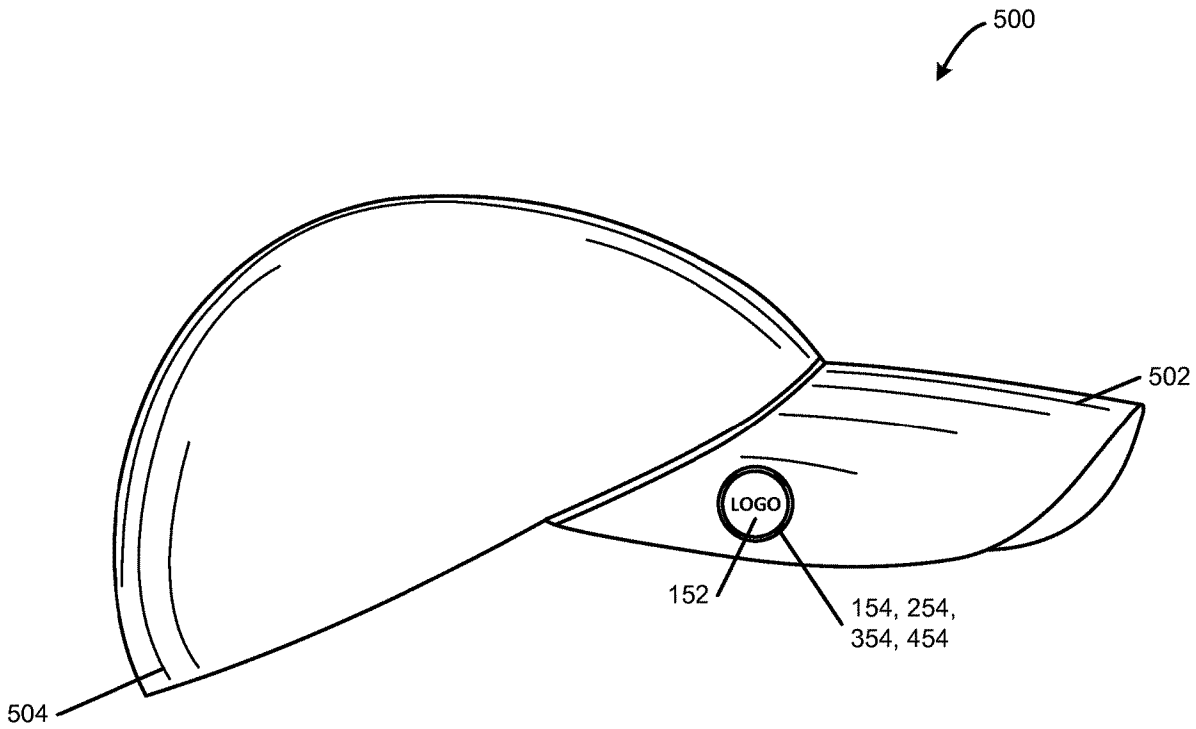
FIG. 5 illustrates a view of an example golf ball marker assembly incorporated into a hat in accordance with one example of this invention.

FIG. 5 illustrates a golf hat (or visor) 500 including a visor component 502 and a head engaging component 504 (which may be a full hat, a visor band that extends all the way around the head, a band of material that extends partially around the head, etc.). In this illustrated example, the housing (e.g., 154, 254, 354, or 454) and removable ball marker 152 are mounted on the right side and on the outside of the visor component 502, although other locations are possible, such as the left side, the center, as well as any desired location on the underside of the visor component 502. The housing (e.g., 154, 254, 354, or 454) and ball marker 152 also could be mounted on the head engaging component 504, as well, if desired. The hat 500 may be of any desired style, including straw hats, brimmed hats, jaunty caps, fedoras, or the like.

Figure 6:
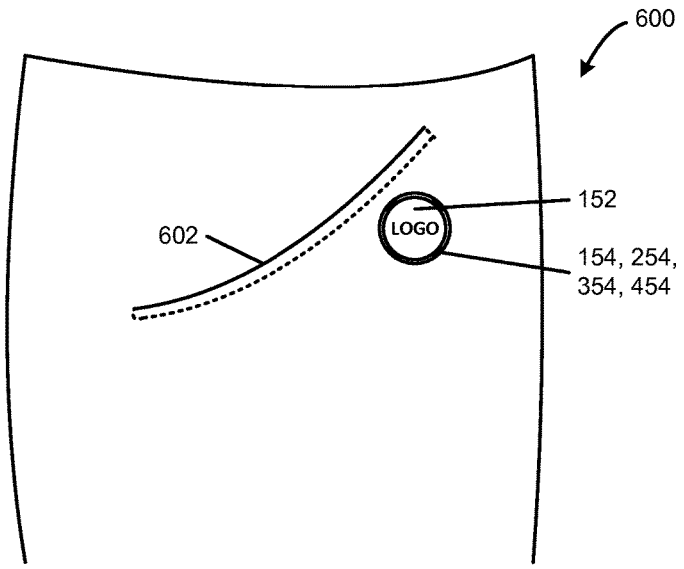
FIG. 6 illustrates a view of an example golf ball marker assembly incorporated into a pocket edge in accordance with one example of this invention.

FIG. 6 illustrates a pair of pants or shorts 600 on which a housing (e.g., 154, 254, 354, or 454) and removable ball marker 152 are mounted. In this illustrated example, the housing (e.g., 154, 254, 354, or 454) and ball marker 152 are mounted along an exterior pocket edge 602 so that it is easily accessible by the golfer. As another alternative, if desired, the housing (e.g., 154, 254, 354, or 454) may be mounted on an interior portion of the pocket structure (e.g., at the interior edge) so that if the marker 152 should inadvertently become dislodged from the housing, it would likely fall downward into the pocket and not be lost. In addition to pants or shorts, housings of this type (e.g., 154, 254, 354, or 454) may be provided on other articles of apparel, such as shirts, rain gear, jackets, sweaters, windshirts, wind breakers, and the like, optionally at pockets and pocket edges of these articles of apparel.

Figure 7:
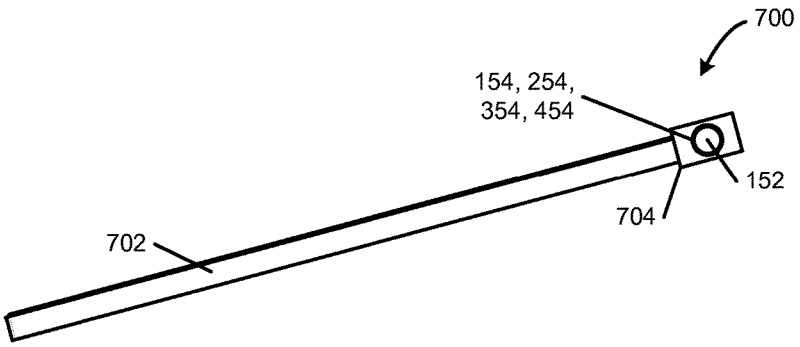
FIG. 7 illustrates a view of an example golf ball marker assembly incorporated into a belt in accordance with one example of this invention.

FIG. 7 shows a belt 700 including a strap 702 and a buckle member 704 in which the housing (e.g., 154, 254, 354, or 454) and removable ball marker 152 are mounted at an exterior surface of the buckle member 704. Rather than providing them on the buckle member 704, if desired, the housing (e.g., 154, 254, 354, or 454) and ball marker 152 may be provided on the strap 702, e.g., so as to be located at a wearer's side when the belt 700 is worn. In addition to belts for pants or shorts, the housing (e.g., 154, 254, 354, or 454) and removable ball marker 152 could be engaged with belts, straps, or buckles provided for other purposes, such as on belts or straps for securing a golf bag to a cart (motorized or pull cart), on watches or watch band straps, etc.

Figure 8:
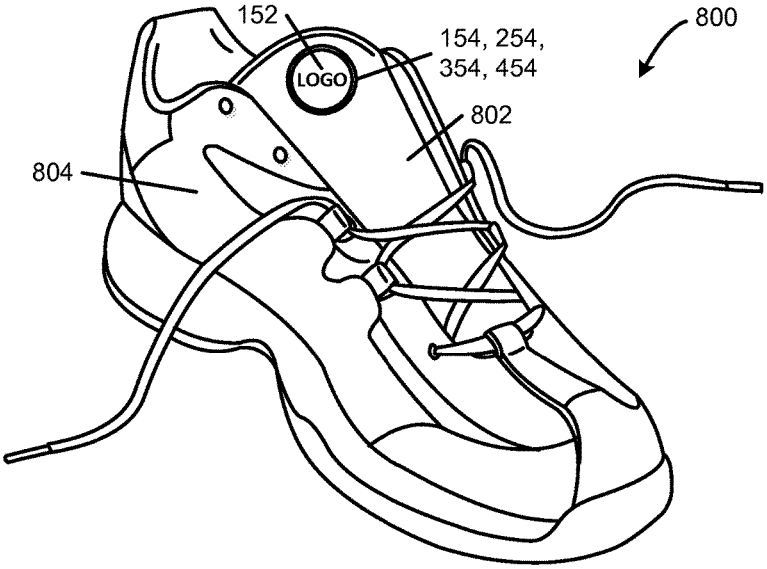
FIG. 8 illustrates a view of an example golf ball marker assembly incorporated into a shoe in accordance with one example of this invention.

Housings (e.g., 154, 254, 354, or 454) and removable ball markers 152 of the types described above also may be incorporated into footwear structures (e.g., golf shoes) in accordance with at least some examples of this invention. FIG. 8 illustrates an example article of footwear 800 in which the housing (e.g., 154, 254, 354, or 454) and removable ball marker 152 are engaged with a tongue portion 802 of the shoe above the laces. As alternatives, if desired, the housing (e.g., 154, 254, 354, or 454) and ball marker 152 may be provided on an upper portion 804 of the shoe, e.g., along the heel side or rear, in an instep area, etc. One or both shoes of a pair may be equipped with housings (e.g., 154, 254, 354, or 454) and/or removable ball markers 152 of the types described above.

Figure 9:
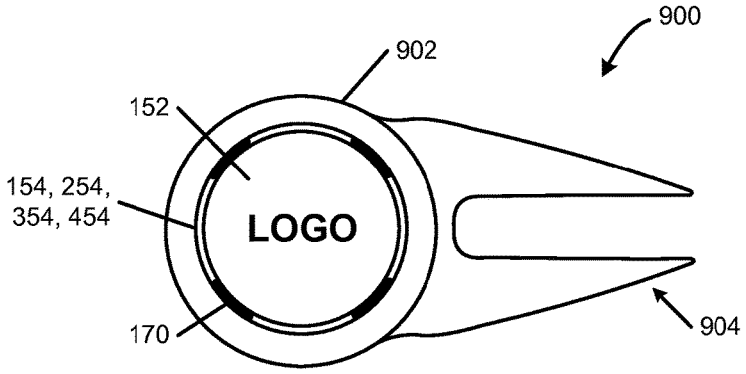
FIG. 9 illustrates a view of an example golf ball marker assembly incorporated into a divot repair tool in accordance with one example of this invention.

In addition to golf gloves 100 as described above, housings (e.g., 154, 254, 354, or 454) and removable ball markers 152 in accordance with examples of this invention may be incorporated into other types of golf equipment. FIG. 9 illustrates a divot repair tool 900 in which a housing (e.g., 154, 254, 354, or 454) and removable ball marker 152 in accordance with an example of this invention is incorporated into the handle portion 902 of the divot tool (and remote from the separated tines of the divot repair component 904).

As still additional examples, housings (e.g., 154, 254, 354, or 454) and removable ball markers 152 in accordance with examples of this invention may be incorporated into golf distance measuring devices (e.g., laser range finders, GPS based devices, including wrist borne devices of this type); on golf bags; on golf carts (motorized or manually operated); at the butt end of a golf club grip; on a surface of a putter; on carrying cases (e.g., for cell phones or other portable electronic devices); etc.

Figure 10A:
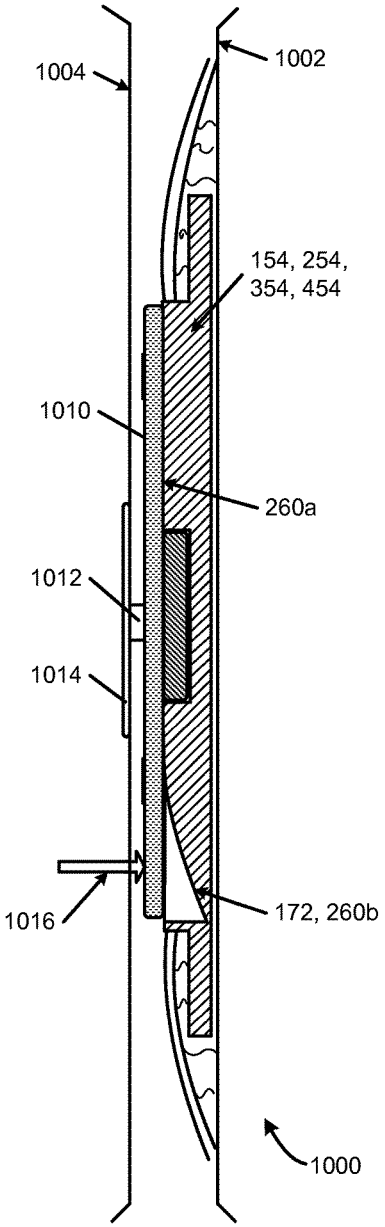
FIGS. 10A and 10B illustrate cross sectional views of a securing system assembly in accordance with other examples of this invention.
Figure 10B:
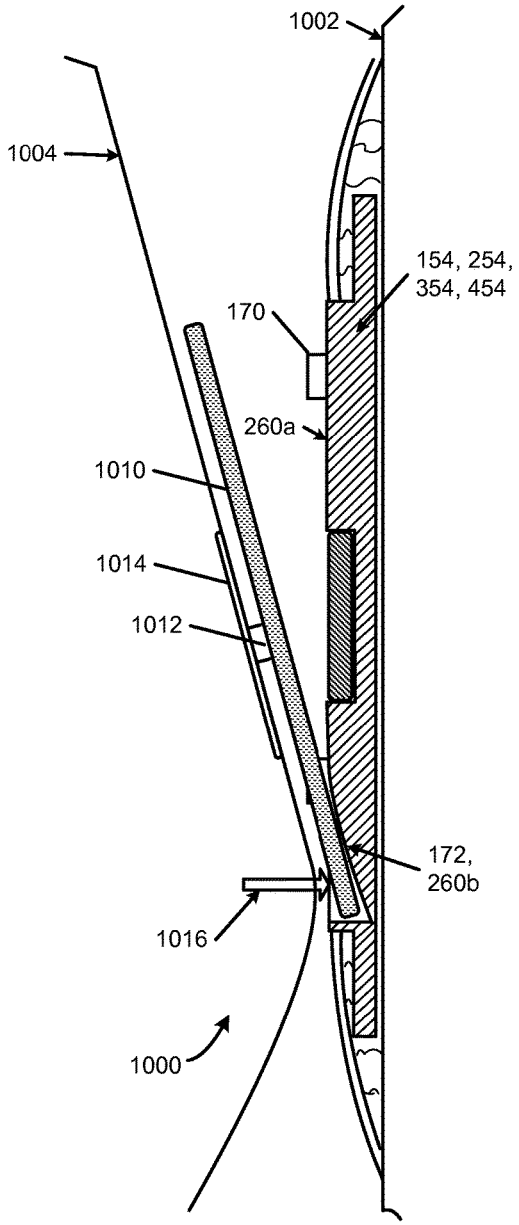

Aspects of this invention are not limited for use in securing golf ball markers to various articles. Rather, aspects of this invention may be used for other types of securing systems, e.g., as replacements for buttons, snaps, hook-and-loop fasteners, and other types of connectors or fasteners. FIGS. 10A and 10B illustrate an example article 1000 in which a housing (e.g., 154, 254, 354, or 454 of the types described above) is engaged with one portion 1002 of the article 1000 (e.g., one side of a shirt or other article to be "buttoned" or "snapped") and a releasable connector 1010 is engaged with the other portion 1004 of the article 1000 (e.g., the other side of the shirt or other article to be "buttoned" or "snapped"). The housing 154, 254, 354, 454 may be engaged with the portion 1002 in any desired manner, such as by sewing or stitching, by mechanical connectors, or by cements or adhesives. The releasable connector 1010 may be engaged with the portion 1004 of the article 1000 to be connected in a permanent or releasable manner. In this illustrated example, the releasable connector 1010 is permanently engaged with the portion 1004 of the article 1000 via a support element 1012 that extends through the portion 1004 of the article to be connected and held there by an enlarged head or stop member 1014. The engagement of the releasable connector 1010 with the portion 1004 may be via any type of mechanical connector of this type (e.g., rivets, thread, etc.) or via adhesives or cements (in which instance the support element 1012 and/or the head or stop member 1014 optionally may be omitted). As another alternative, if desired, the head or stop member 1014 may be removable from the support element 1012 and/or the portion 1004 so that it can be interchanged with another head or stop member 1014.

As further shown in FIGS. 10A and 10B, the releasable connector 1010 may function in the overall securing system in a manner similar to the way in which the ball marker 152 functions in the various embodiments described above. As shown in these figures, the connector 1010 may be released from the housing (e.g., 154, 254, 354, or 454) by applying a force (shown by arrow 1016) at the non-coplanar portion 260*b* side of the mount surface 260*a* (or at opening 172 in housings including such openings). This action lifts the opposite end of the connector 1010 above the tops of retaining wall(s) 170 to enable the connector 1010 to be easily slid off the mount area 260*a*. The connector 1010 can be easily re-engaged by aligning the connector 1010 within the inner perimeter area 170*b* defined between walls 170 (magnetic attraction between the connector 1010 and the mount area 260*a* helps engage these elements and properly seat the connector 1010 on the mount area 260*a*).

Figure 11A:
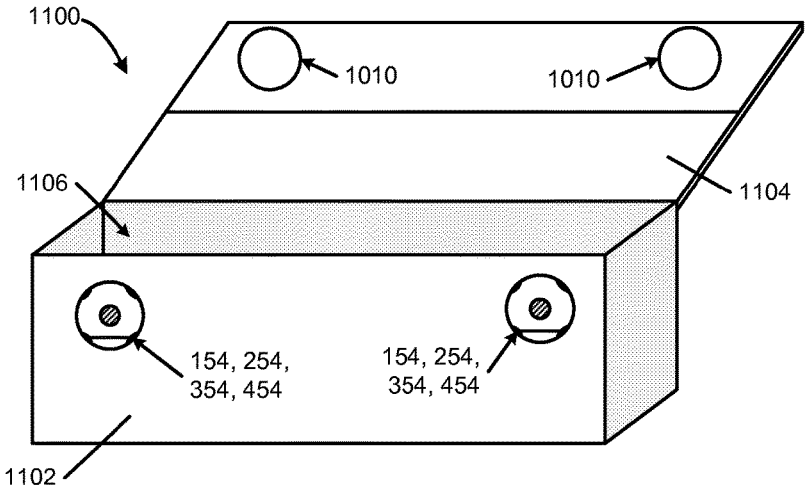
FIGS. 11A and 11B illustrate an example container having a closure flap with a securing assembly in accordance with still other examples of this invention.
Figure 11B:
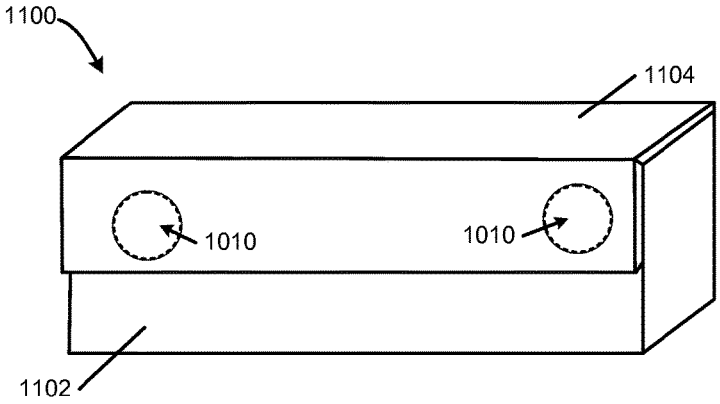

Releasable connectors 1010 of the types described above are not limited for use on apparel. FIGS. 11A and 11B show releasable connectors 1010 of the types described above used for closing a container 1100, such as a box, briefcase, satchel, purse, bag, or the like. In this illustrated example, a base portion 1102 of the container 1100 includes the housing (e.g., 154, 254, 354, 454) engaged with it (e.g., by mechanical connectors, by sewing or stitching, by adhesives, etc.) and a flap portion 1104 of the container 1100 includes the connector 1010 (e.g., engaged in any of the various manners described above). In use, as shown by a comparison of FIGS. 11A and 11B, the container 1100 may be closed by extending the flap 1104 over the interior chamber 1106 of the container 1100, and the flap 1104 may be secured in place using the connector assembly (by engaging connector element 1010 with the housing 154, 254, 354, 454 in the manner generally described above in conjunction with FIGS. 10A and 10B). The flap 1104 may be shaped to cover all or a portion of the opening to the interior chamber 1106 and/or it may be shaped to extend over the side walls of the container beyond the edges of the interior chamber 1106. The releasable connector 1010 may be released from the housing 154, 254, 354, 454 in the manner described above in conjunction with FIGS. 10A and 10B.

Figure 12A:
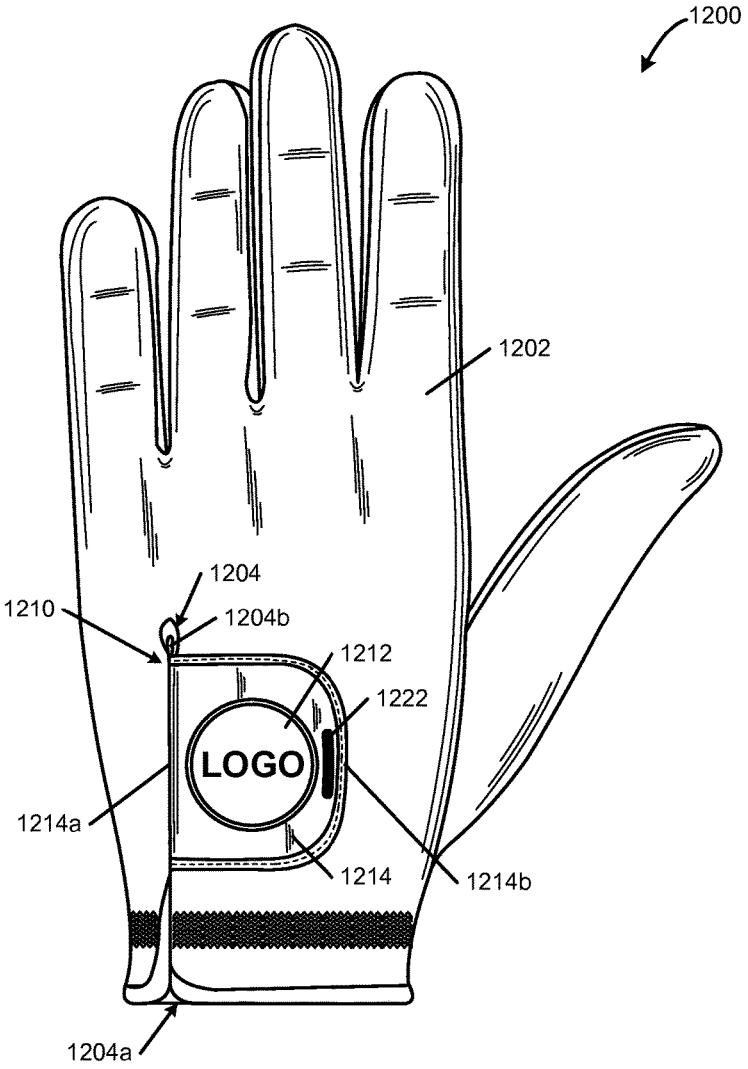
FIGS. 12A through 12C illustrate example gloves including closure systems with a notched grasping area in accordance with some examples of this aspect of the invention.
Figure 12B:
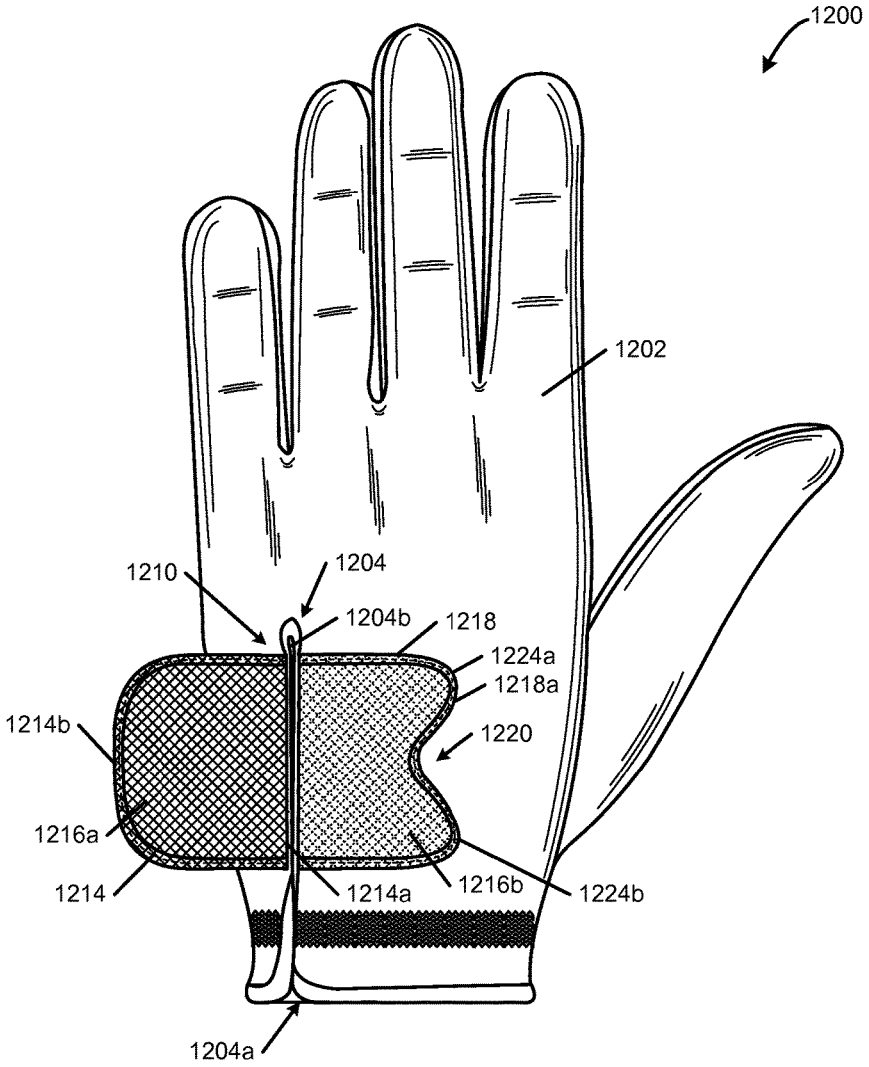
Figure 12C:
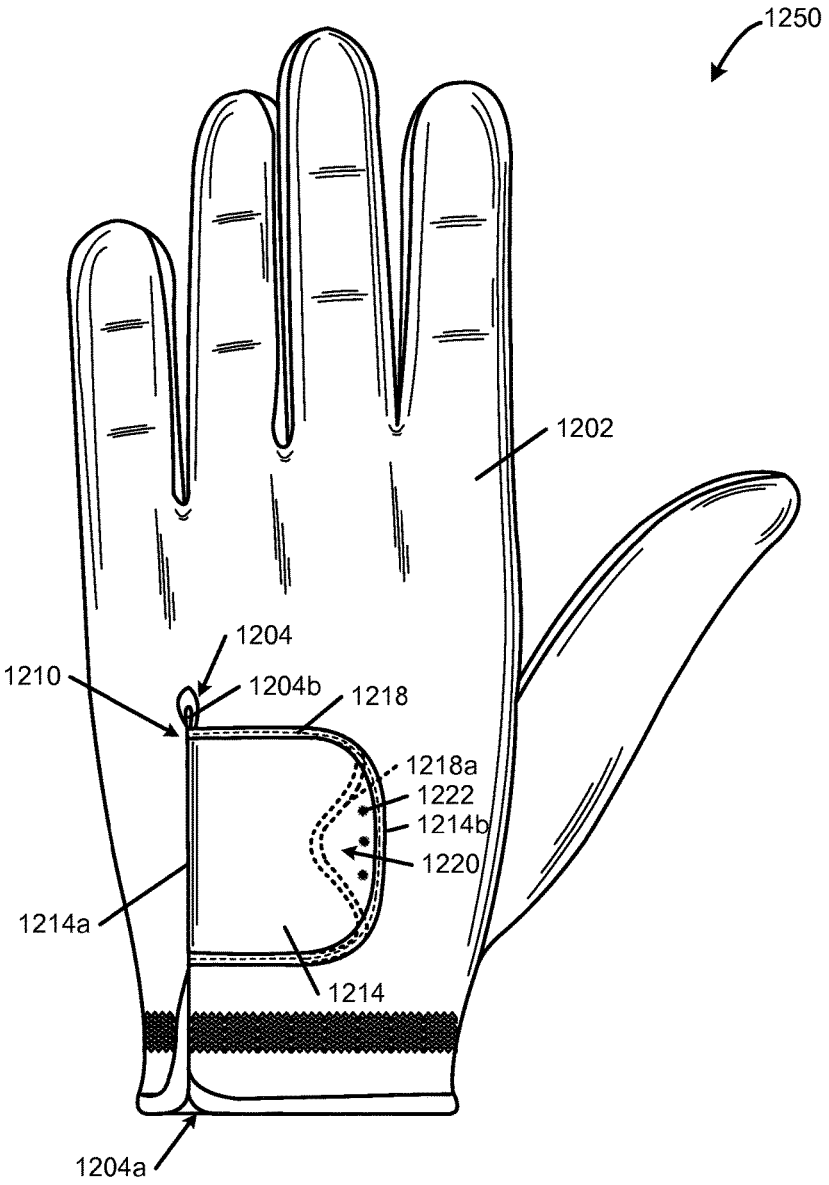
Figure 13:
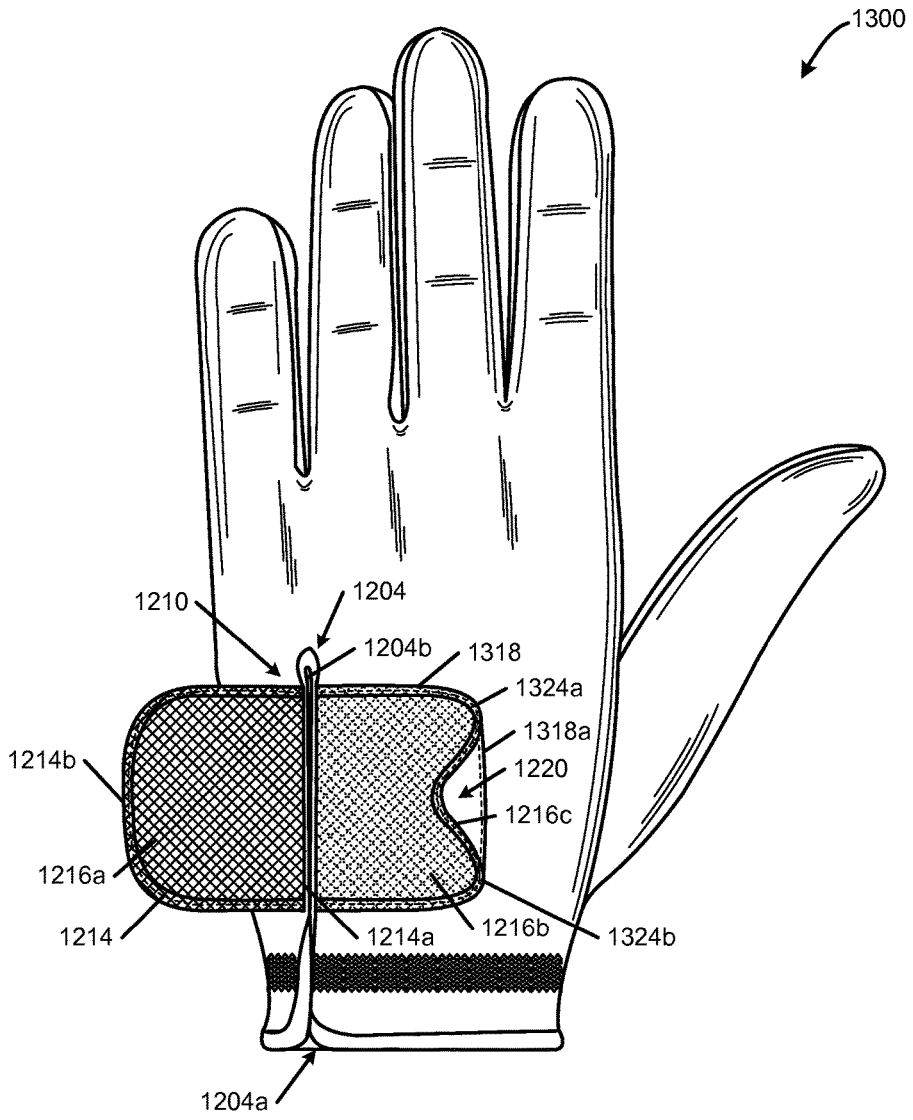
FIG. 13 illustrates another example closure system with a notched grasping area in accordance with this aspect of the invention.

FIGS. 12A through 13 show examples of features of closure and/or securing systems according to other aspects of this invention. FIGS. 12A and 12B illustrate an example glove structure 1200 including a closure system 1210 in accordance with this example of the invention. While a golf glove is illustrated, given the benefit of this disclosure, those skilled in the art will understand that features of this aspect of the invention may be applied to other types of gloves and/or used with other types of closure systems and securing systems.

As shown in FIGS. 12A and 12B, this example golf glove structure 1200 includes a glove member 1202 that includes an opening 1204 for receiving a wearer's hand. This glove member 1202 may be made from any desired materials, any desired number of parts, and any desired construction without departing from this invention. As also shown in FIGS. 12A and 12B, the opening 1204 of this example structure 1200 includes a transverse bottom opening area 1204*a* and a longitudinal opening area 1204*b*. The glove member 1202 may include other features and structures that are commonly incorporated into glove constructions, including common features of golf glove constructions as are known and used in the art.

The glove 1200 of this example further includes a closure system 1210 engaged with the glove member 1202. While the closure system 1210 may include a magnetic ball marker securing system and ball marker, e.g., as described above in conjunction with FIGS. 1A through 4, this is not a requirement in all structures according to this aspect of the invention. The example structure of FIGS. 12A and 12B includes a static or permanent logo or other design element 1212 (FIG. 12A), but no logo or design element need be provided on the closure system 1210, if desired (see FIG. 12C).

The closure system 1210 of this example structure 1200 includes a flap component 1214 that has a first portion of a hook-and-loop fastener 1216*a* integrally formed or engaged with it (e.g., the "loop" portion). While any desired type of construction or engagement with the glove member 1202 may be provided, in this illustrated example, a first edge 1214*a* of the flap component 1214 is engaged with the glove member 1202 on a first side of the longitudinal opening area 1204*b* by sewing or stitching. While a direct engagement is shown in FIGS. 12A and 12B, if desired, one or more elastic members may be provided between the edge 1214*a* of the flap 1214 and the glove member 1202 so that the flap 1214 can be stretched around the wearer's hand to tighten it. Additionally or alternatively, if desired, the first edge 1214*a* of the flap component 1214 may be engaged on the first side of the longitudinal opening area 1204*b* at a location somewhat remote from the opening 1204*b*, such as along a seam between a front panel of the glove member 1202 and a rear panel of the glove member 1202. Other flap engagement locations, techniques, and/or structures also may be used without departing from this invention.

The flap component 1214 further includes a free edge 1214*b* located opposite the first or engaged edge 1214*a*, While the edges 1214*a* and 1214*b* may be parallel, straight, and/or similarly shaped, this is not a requirement. In the example of FIGS. 12A and 12B, the engaged edge 1214*a* is relatively straight whereas the free edge 1214*b* is somewhat curved, at least at its corners.

The closure system 1210 of this example glove structure 1200 further includes a base component 1218 having a second portion of the hook-and-loop fastener 1216*b* engaged or integrally formed with it. The base component 1218 is engaged with the glove member 1202 (e.g., a rear panel of a glove member 1202) on the opposite side of the longitudinally oriented opening 1204*b* from the flap component 1214. The base component 1218 may be engaged with the glove member 1202 in any desired manner without departing from this invention, including via stitching or sewing, via cements or adhesives, via fusing techniques, etc.

The edge 1218*a* of the base component 1218 that corresponds to the free edge 1214*b* of the flap component 1214 when the closure system 1210 is engaged includes a "notched area" 1220 that does not include the second portion of the hook-and-loop fastener 1216*b*. In this manner, the free edge 1214*b* of the flap component 1214 extends over the notched area 1220 when the first and second portions of the hook-and-loop fastener 1216*a*, 1216*b* are engaged together to close the opening longitudinal 1204*b*. If desired (and as shown in the example of FIGS. 12A and 12B), the portion of the flap component 1214 that extends over the notched area 1220 may still include the first portion of the hook-and-loop fastener 1216*a*, even though this first portion of the hook-and-loop fastener 1216*a* will not find any of the second portion of the hook-and-loop fastener 1216*b* to engage with when secured. Alternatively, if desired, the first portion of the hook-and-loop fastener 1216*a* could be omitted, e.g., and just a bare portion of the flap component 1214 may extend over the notched area 1220.

In some conventional glove constructions, particularly glove constructions that utilize low profile hook-and-loop fastener elements (e.g., thin hook-and-loop fasteners), the flap can be difficult to grasp to remove the glove because each part of the hook-and-loop fastener element is very thin. The notched area 1220 in glove constructions in accordance with this aspect of the invention provides an unsecured grasping area on the flap component 1214 when the hook-and-loop fastener portions 1216*a* and 1216*b* are engaged. This feature allows the wearer to more easily bend and grasp the flap component 1214, enlarge the opening 1204, and remove the glove 1200 from the hand. More specifically, the unsecured portion of the flap component 1214 keeps a portion of the free edge 1214*b* of the flap 1214 unsecured so that a finger can more easily slide under the flap 1214 to grab it and pull it away from the base component 1218. This notched area 1220 feature allows the use of low profile or ultra-low profile hook-and-loop fasteners in glove constructions while still providing glove constructions that are easily securable and releasable. Hook-and-loop fasteners in which the first and second portions of the hook-and-loop fastener, when engaged together, have an overall thickness of less than ⅜ inch thick, less than ¼ inch thick, less than 3/16 inch thick, or even less than ⅛ inch thick, may be used in at least some example structures in accordance with this aspect of the invention.

The notched area 1220 may take on any desired shape without departing from this invention. In this illustrated example, the edge 1218*a* of the base component 1218 that provides the notched area 1220 (or at least a portion of this edge 1218*a*) is smoothly curved to form the notched area 1220. The corresponding edge of the second portion of the hook-and-loop fastener 1216*b* is also curved to correspond to the curve of edge 1218*a*. Thus, the rear panel of the glove member 1202 is exposed within the notched area 1220 of this example structure 1200. Other arrangements are possible. For example, rather than a relatively smooth curve, the edge 1218*a* and the notched area 1220 may be formed with more square corners and/or in a more angular manner without departing from this aspect of the invention.

In this example structure 1200, the top portion 1224*a* and the bottom portion 1224*b* of the edge 1218*a* of the base component 1218 extend outward (toward the thumb-side of the glove 1200) to an extent so as to fully underlie and engage the free edge 1214*b* of the flap component 1214 while the free edge 1214*b* of the flap component 1214 extends beyond the edge 1218*a* of the base component 1218 at the notched area 1220. This feature helps keep the flap component 1214 secure on the base component 1218 (e.g., when the gloved hand is placed in and/or removed from a pocket) because there are no unsecured corners of the flap component 1214 that might get grabbed inadvertently. Rather, the top and bottom corners of the flap component 1214 are secured, and the notched area 1220 provides a central grasping area to better allow release of the flap component 1214.

In order to better maintain the secure connection as described above, in this illustrated glove structure 1200, the first portion of the hook-and-loop fastener 1216*a* covers at least 90% (and in some examples, at least 95% or even at least 98%) of a major surface of the flap component 1214 to which it is secured. Additionally or alternatively, if desired, this first portion of the hook-and-loop fastener 1216*a* may extend right up to and along the free edge 1214*b* (and other edges thereof) of the flap component 1214. Similarly, the second portion of the hook-and-loop fastener 1216*b* of this example 1200 covers at least 90% (and in some examples, at least 95% or even at least 98%) of a major surface of the base component 1218. Additionally or alternatively, if desired, this second portion of the hook-and-loop fastener 1216*b* may extend right up to and along the edge 1218*a* of the base component 1218 (and other edges thereof). In this illustrated example 1200, the notched area 1220 is defined by an inward extension (e.g., an inward curvature) of the edge 1218*a* of the base component 1218.

As further shown in FIG. 12A, a grasping element 1222 may be provided on the flap component 1214, optionally over the notched area 1220, to further enhance the improved grasping features of this aspect of the invention. The grasping element 1222 may take on any desired construction without departing from this invention, including a raised rib (e.g., made of a rubber type material), a plurality of raised ribs or other structures, one or more recessed grooves, other recessed structures, etc. Additionally or alternatively, one or more grasping elements may be provided on the underside of the flap component 1214 near the notched area 1220, if desired.

FIG. 12C shows a rear view of another example glove structure 1250 in accordance with this aspect of the invention. The glove structure 1250 shown in FIG. 12C is similar to that shown in FIGS. 12A and 12B (and similar reference numbers are used for the same or similar parts), but the flap 1214 does not include the logo element 1212 and the optional grasping element 1222 is of a somewhat different construction (small raised cylinders made of rubber-type material). FIG. 12C further shows the base component 1218 (which is covered by the flap member 1214 in the view shown), in broken lines, to better illustrate the location of the notched area 1220 and the relative locations of the flap component 1214 and the base component 1218 when the hook-and-loop fastener portions 1216*a* and 1216*b* are engaged.

FIG. 13 shows a rear view of another example glove structure 1300 in accordance with this aspect of the invention. The glove structure 1300 shown in FIG. 13 is similar to those shown in FIGS. 12A through 12C (and similar reference numbers are used for the same or similar parts), but the base component 1318 is somewhat different in this glove structure 1300. More specifically, as shown, the base component 1318 with which the second portion of the hook-and-loop fastener 1216*b* is engaged has its outer edge 1318*a* extending through the notched area 1220. Thus, in this example structure, the notched area 1220 includes the base component 1318 but not the second portion of the hook-and-loop fastener 1216*b*. Also, while not a requirement, the base component 1318 is of generally the same size and shape as the flap component 1214 (e.g., so that the flap component 1214 will substantially cover the base component 1318 when engaged). This structure still creates the notched area 1220 for grasping where the first portion of the hook-and-loop fastener 1216*a* does not engage the second portion of the hook-and-loop fastener 1216*b* (e.g., the second portion of the hook-and-loop fastener 1216*b* has a notched edge 1216*c* while the base component edge 1318*c* is not notched).

In this example structure 1300, the first portion of the hook-and-loop fastener 1216*a* covers at least 90% (and in some examples, at least 95% or even at least 98%) of a major surface of the flap component 1214, and the second portion of the hook-and-loop fastener 1216*b* covers less than 95% (and in some examples, less than 90% or even less than 85%) of a major surface of the base component 1318. Additionally or alternatively, the first portion of the hook-and-loop fastener 1216*a* extends right to and along the free edge 1214*b* of the flap component 1214 (as well as to any of the other edges thereof), and the second portion of the hook-and-loop fastener 1216*b* may extend right to a top portion 1324*a* of the edge 1318*a* of the base component 1318 and right to a bottom portion 1324*b* of the edge 1318*a* of the base component 1318, but the second portion of the hook-and-loop fastener 1216*b* does not extend to the edge 1318*a* of the base component 1318 for a portion of the edge 1318*a* between the top portion 1324*a* and the bottom portion 1324*b* to thereby define the notched area 1220. In this illustrated example 1300, the notched area 1220 is defined by an inward extension (e.g., an inward curvature) of the outer edge of the second portion of the hook-and-loop fastener 1216*b*.

The notched area 1220 features of FIGS. 12A through 13 may be applied to structures other than gloves without departing from this invention. For example, this type of securing system could be utilized with any type of closure element or securing system that utilizes a hook-and-loop fastener arrangement. More specific examples include: articles of clothing, articles of footwear, sporting equipment, bags, containers, case, as replacements for buttons or snaps, etc. Also, while the gloves depicted and discussed are athletic gloves (and particularly golf gloves), and the concepts disclosed with respect to various aspects of these gloves may be applied to a wide range of athletic glove structures, including, but not limited to: batting gloves, football gloves, weightlifting gloves, and gloves for other sports. In addition, at least some concepts and aspects of the present invention may be applied to a wide range of non-athletic gloves, including gardening gloves, yard work gloves, cleaning gloves, work gloves, and gloves for other activities. Even further, the concepts disclosed herein may be applied to other hand-receiving devices or structures, for example, partial gloves, protective hand sheaths and/or manual and remote controllers, hand-receiving devices for use in playing games such as video games, etc. Accordingly, the present invention is not limited to the precise embodiments disclosed herein, but also applies to glove and hand-receiving devices generally.

III. Conclusion

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

What is claimed is:

1. A glove comprising:

a glove member including a front panel, a rear panel, and an opening for receiving a wearer's hand; and a closure system engaged with the glove member and including:

a flap component including a first portion of a hook-and-loop fastener, a flap edge engaged with the glove member on a first side of the opening, and a free edge located opposite the flap edge, and a base component including a second portion of the hook-and-loop fastener engaged with the rear panel of the glove member and including (i) a first edge located along a second side of the opening, (ii) a second edge extending away from the second side of the opening substantially perpendicular to the first edge, (iii) a third edge opposite the second edge and extending away from the second side of the opening substantially perpendicular to the first edge, and (iv) a fourth edge opposite the first edge and extending between the second edge and the third edge, the fourth edge of the base component defining a notched area extending toward the second side of the opening to expose the rear panel of the glove member within the notched area, the fourth edge including (i) a curved top portion extending from the second edge, (ii) a substantially straight first notch edge extending tangentially and at a first oblique angle from the curved top portion towards the first edge, (iii) a curved bottom portion extending from the third edge, and (iv) a substantially straight second notch edge extending tangentially and at a second oblique angle from the curved bottom portion towards the first edge, the first notch edge and the second notch edge converging with each other and tangentially intersecting an arcuate inner edge.

2. The glove of claim 1, wherein the free edge of the flap component is operable to extend over the notched area when the first portion and the second portion of the hook-and-loop fastener are engaged together.

3. The glove of claim 1, wherein a portion of the free edge of the flap component that extends over the notched area includes some of the first portion of the hook-and-loop fastener.

4. The glove of claim 1, wherein at least one of the first edge, the second edge, and the third edge are substantially linear.

5. The glove of claim 1, wherein the curved top portion and the curved bottom portion of the fourth edge of the base component extend outward to an extent so as to fully underlie and engage a top portion and a bottom portion of the free edge of the flap component.

6. The glove of claim 1, wherein the free edge of the flap component extends beyond the fourth edge of the base component at the notched area.

7. A glove comprising:

a glove member including a front panel, a rear panel, and an opening for receiving a wearer's hand; and a closure system engaged with the glove member and including:

a flap component including a first portion of a hook-and-loop fastener, a flap edge engaged with the rear panel, and a free edge located opposite the flap edge, and a base component including a second portion of the hook-and-loop fastener engaged with the rear panel of the glove member and including (i) a first edge disposed substantially parallel to the flap edge, (ii) a second edge extending away from the first edge substantially perpendicular to the first edge, (iii) a third edge opposite the second edge and extending away from the first edge substantially perpendicular to the first edge, and (iv) a fourth edge opposite the first edge and extending between the second edge and the third edge, the fourth edge of the base component defining a notched area extending toward the first edge to expose the rear panel of the glove member within the notched area, the fourth edge including (i) a curved top portion extending from the second edge, (ii) a substantially straight first notch edge extending tangentially and at a first oblique angle from the curved top portion towards the first edge, (iii) a curved bottom portion extending from the third edge, and (iv) a substantially straight second notch edge extending tangentially and at a second oblique angle from the curved bottom portion towards the first edge, the first notch edge and the second notch edge converging with each other and tangentially intersecting an arcuate inner edge.

8. The glove of claim 7, wherein the free edge of the flap component is operable to extend over the notched area when the first portion and the second portion of the hook-and-loop fastener are engaged together.

9. The glove of claim 7, wherein a portion of the free edge of the flap component that extends over the notched area includes some of the first portion of the hook-and-loop fastener.

10. The glove of claim 7, wherein at least one of the first edge, the second edge, and the third edge are substantially linear.

11. The glove of claim 7, wherein the curved top portion and the curved bottom portion of the fourth edge of the base component extend outward to an extent so as to fully underlie and engage a top portion and a bottom portion of the free edge of the flap component.

12. The glove of claim 7, wherein the free edge of the flap component extends beyond the fourth edge of the base component at the notched area.

* * * * *